US006554925B2

(12) United States Patent
Inoue et al.

(10) Patent No.: US 6,554,925 B2
(45) Date of Patent: Apr. 29, 2003

(54) METHOD FOR MANUFACTURING COLD-ROLLED STEEL SHEET

(75) Inventors: Tadashi Inoue, Fukuyama (JP); Yasuhide Ishiguro, Fukuyama (JP); Yoichi Motoyashiki, Fukuyama (JP); Sadanori Imada, Fukuyama (JP); Toru Inazumi, Ann Arbor, MI (US)

(73) Assignee: NKK Corporation, Tokyo (JP)

( * ) Notice: Subject to any disclaimer, the term of this patent is extended or adjusted under 35 U.S.C. 154(b) by 0 days.

(21) Appl. No.: 09/821,609

(22) Filed: Mar. 29, 2001

(65) Prior Publication Data

US 2001/0039983 A1 Nov. 15, 2001

Related U.S. Application Data

(63) Continuation of application No. PCT/JP00/05318, filed on Aug. 9, 2000.

(30) Foreign Application Priority Data

| | | |
|---|---|---|
| Aug. 10, 1999 | (JP) | 11-225960 |
| Feb. 29, 2000 | (JP) | 2000-053729 |
| Feb. 29, 2000 | (JP) | 2000-053730 |
| Jun. 22, 2000 | (JP) | 2000-187310 |

(51) Int. Cl.[7] ..... C21D 8/04
(52) U.S. Cl. ..... 148/603; 148/651

(58) Field of Search ..... 148/602, 603, 148/651, 654

(56) References Cited

FOREIGN PATENT DOCUMENTS

JP 401188626 A * 7/1989 ..... C21D/9/46

OTHER PUBLICATIONS

U.S. patent application Ser. No. 09/827,597, Inoue et al., filed Apr. 5, 2001.
U.S. patent application Ser. No. 09/837,435, Inoue et al., filed Apr. 18, 2001.
U.S. patent application Ser. No. 09/838,017, Inoue et al., filed Apr. 19, 2001.
U.S. patent application Ser. No. 09/864,473, Nakata et al., filed Apr. 24, 2001.

* cited by examiner

*Primary Examiner*—Deborah Yee
(74) *Attorney, Agent, or Firm*—Frishauf, Holts, Goodman & Chick, P.C.

(57) ABSTRACT

The method for manufacturing cold-rolled steel sheet comprises the steps of: rough-rolling a slab using a rough-rolling unit; finish-rolling the sheet bar using a continuous hot finishing-rolling mill; cooling the hot-rolled steel strip on a runout table; coiling thus cooled hot-rolled steel strip; and applying picking, cold-rolling the hot-rolled steel strip, and final annealing to the cold-rolled steel strip.

22 Claims, 1 Drawing Sheet

METHOD FOR MANUFACTURING COLD-ROLLED STEEL SHEET

This application is a continuation application of International application PCT/JP00/05318 (not published in English) filed Aug. 9, 2000.

BACKGROUND OF THE INVENTION

1. Field of the Invention

The present invention relates to a method for manufacturing cold-rolled steel sheet.

2. Description of the Related Arts

Cold-rolled steel sheets are widely used as basic materials for exterior sheets of automobiles and other equipment. Since the major form of the cold-rolled steel sheets for automobiles is press-formed members, various kinds of workability characteristics are required responding to the shapes of the members. In particular, automobile-use requests the cold-rolled steel sheets for press-forming having excellent deep-drawing performance suitable for exterior sheets for automobiles. Recently, the request of automobile manufacturers relating to rationalization becomes severer than ever, particularly in the request for cost reduction of base materials and for improvement in production yield. To cope with these requirements, the material manufacturing faces serious issues of rationalization of manufacturing method, improvement of material quality, and homogeneity of material.

Based on the above-described background, and in view of rationalization of manufacturing method and improvement of material quality, JP-B-60-45692, (the term "JP-B-" referred to herein signifies the "Examined Japanese Patent Publication"), discloses a technology for improving the surface properties and the deep-drawing performance of a steel sheet using a process of continuous casting and direct feeding to rolling by hot-rolling a very low carbon steel slab containing not more than 0.015% C, wherein the hot rolling is begun in a range of temperature of the surface at center of the slab width from 600° C. to less than 900° C., and applying soaking within a period of 30 minutes during the hot-rolling step.

From the point of improvement of material quality, JP-A-5-112831, (the term "JP-A-" referred to herein signifies the "Unexamined Japanese Patent Publication"), discloses a technology for improving the r value by applying a final reduction in thickness during the hot-rolling to 30% or more, and by beginning rapid cooling immediately after the completion of hot-rolling, thus reducing the grain size in the hot-rolled steel sheet.

The above-described prior arts, however, leave a problem on the uniformity of mechanical properties within a coil, though the surface properties and the deep drawing performance of the cold-rolled steel sheet are improved to a relatively favorable level. That is, the technology of JP-B-60-45692 adopts the heating temperature in the hot-rolling step to a low level, or to the ferritic domain. Accordingly, the congregation texture of the steel sheet after the hot-rolling differs in the width direction thereof owing to the temperature distribution in the material width direction during the rolling, (temperature reduction is significant at edges and peripheral zone thereof). As a result, the mechanical properties of the steel sheet in the coil width direction induce dispersion after cold-rolling and annealing.

If the structure and the mechanical properties of the steel sheet in the coil width direction generated dispersion, the workability within a plane of the material becomes non-homogeneous. Particularly when superior deep drawing performance is requested for the exterior sheets of automobiles and other uses, the quality of press-formed steel sheets have variations (such as cracks and wrinkles). Consequently, the automobile manufacturers have to apply blank layout in a coil under a low yield condition, (or to apply blank layout in a non-reasonable direction such as 45 degrees, or the product is not cut from nearby zone to coil edges).

Also in the technology of JP-A-5-112831, the dispersion of material quality can not necessarily be reduced to a satisfactory level. That is, with the range of cooling speed that is a feature of the technology, (according to the examples given in JP-A-5-112831, the average cooling speed in a period of one second from the start of cooling ranges from 90 to 105° C./sec, and the average cooling speed in a period of 3 seconds after the start of cooling ranges from 65 to 80° C./sec), the time until the start of cooling becomes long under the commercial hot-rolling conditions because particularly the cooling speed at top section of the rolling is slow, which allows the enhancement of coarse grain formation owing to the austenitic grain growth. Consequently, it was found that these sections are not necessarily able to prepare fine grains in the hot-rolled steel sheet.

In addition, the cooling immediately after the hot-rolling, which is a feature of the technology, is difficult to be actualized on commercial facilities because of the structural limitation thereof. That is, instruments have to be installed so that the cooling unit cannot be positioned directly next to the exit of the final stand of the finish rolling mill. Therefore, to bring the time to start cooling after completed the hot-rolling to 0.1 second or less is substantially difficult. Furthermore, since the technology adopts a large reduction in thickness, 30% or more, at the final stand of the finish rolling mill, the travel of steel sheet becomes unsteady and likely induces bad sheet shapes. With the bad shapes of hot-rolled coil sheet, users have a problem of unable to perform press-forming at a high yield.

As described above, practical application of the technology of JP-A-5-112831 has many issues yet to be solved.

In this regard, an object of the present invention is to provide a method for manufacturing cold-rolled steel sheet for deep drawing, which method solves the above-described problems of prior art, and allows to manufacture cold-rolled steel sheets suitable for the uses as exterior sheets for automobiles and other uses, giving superior press-formability with less variations in press-formability within a coil, on an industrially stable basis.

Another object of the present invention is to provide a method for manufacturing cold-rolled steel sheet for deep drawing, which method allows to manufacture cold-rolled steel sheets having superior sheet shape adding to the advantages described above, on an industrially stable basis.

As for the cold-rolled steel sheet and the surface-treated steel sheet, which are required to have good workability, they need to have mechanical properties of superior elongation and deep drawing performance, and less anisotropic property. The shape of steel sheet and the transferability of the hot-rolled steel strip during manufacturing process are also important variables to manufacture that kind of steel sheet.

According to prior art, mildness and high ductility are gained in very low carbon and nitrogen base compositions by adding elements to form carbide and elements to form nitride, such as Ti and Nb. The concept is based on that the interstitial elements such as carbon and nitrogen are eliminated as far as possible during the steel making stage, and that the interstitial elements at a level being left non-eliminated or the interstitial element at a level that cannot be eliminated on an economical basis are fixed as precipitates, thus rejecting the presence of interstitial elements in the steel.

With the increasing severity in requirements for workability, however, sole composition adjustment cannot anymore provide steel sheets that satisfy the requirements, and the manufacturing process is requested to contribute to further improvement of the material quality. It is known that, in concept, the effective use of the cooling technology improves the mechanical properties of steel sheets after cooling and annealing by reducing the grain size in the hot-rolled steel sheets. The procedure is to simultaneously apply the following-given two steps to reduce the grin size in the hot-rolled steel sheets: (1) to shorten the time between the completion of the hot-rolling and the start of the cooling step, (hereinafter referred to as the "time to start cooling"), and (2) to increase the cooling speed as far as possible.

The basis of the technology is the following. For the step (1), since the strain which is induced during the finish-rolling recovers to induce recrystallization after completing the hot-rolling, as well as the γ (austenite) grain growth promptly begins, (a) the cooling starts when the γ grains are still in small size, and the α (ferrite) grains are formed from the fine γ grain boundaries, thus generating fine grains, or (b) the cooling starts within further short time to form α grains as the deformation band in γ grains as the nuclei in a state that the work strain during the hot-rolling step is not fully released, thus achieving the formation of fine grains.

As for the above-described step (2), when the cooling speed is slow, the recovery and recrystallization of γ grains and grain growth occur during the cooling step, and the growth of α grains occurs after the transformation, thus the cooling speed is increased to achieve the reduction of α grain size. In addition, there is an advantage that, by increasing the cooling speed, the γ–α transformation point is lowered, and the grain growth after the transformation is suppressed to a magnitude corresponding to the reduced temperature after the transformation.

In view of experimental studies, for example, Zairyo To Process (Current Advance in Materials and Processes), Kino et al. vol.3, p.785 (1990) discloses a finding that, when the grain size reduction in a hot-rolled steel sheet is carried out by applying the finish temperature held to $Ar_3$ transformation point or higher level, and applying (a) the cooling starting after 0.1 second from the completion of hot-rolling, then applying (b) the cooling with about 180° C./sec of the cooling speed, then the mechanical properties, particularly the r value, after cold-rolled and annealed are improved.

Regarding the material quality improvement by applying cooling to reduce the grain size in hot-rolled steel sheet, various methods for manufacturing thereof have been disclosed. For example, JP-A-7-70650 discloses a method for achieving 2.50 or higher r value with a very low carbon (15 ppm or less C) steel sheet. According to the method, the finish-rolling is completed at $Ar_3$ transformation point or higher temperature, then the time to start cooling is set to within 0.5 second after completing the rolling, and the cooling is conducted at cooling speeds of from 50 to 400° C./sec over the temperature range of from the cooling start temperature to the ($Ar_3$ transformation point−60° C.). The method, however, specifies the cumulative reduction in thickness in 3 passes at the exit side of the finish-rolling of hot-rolling to 50% or more. The method aims to actualize 2.50 or higher r value and deep drawing performance through the grain size reduction in the hot-rolled steel sheet using the cooling technology and through the accumulation of large quantity of work strain in the hot-rolling step.

With the technology disclosed by Kino et al. and the technology disclosed in the above-given patent publications, however, all the mechanical properties including r values cannot necessarily be always satisfied under all kinds of conditions. And, under some conditions, the workability such as the r value and the elongation are not improved, or rather degraded. On accumulating large amount of work strain during the hot-rolling step, the shape of steel sheet may be disturbed to induce problems on transferability of the steel sheet. That is, there has not been attained process condition that stably manufactures steel sheets having superior shape and transferability, and having significantly superior workability such as r value and elongation, in prior art.

The present invention was completed to cope with the above-described problems, and an object of the present invention is to provide a method for manufacturing cold-rolled steel sheet that has a very low carbon and nitrogen basis composition and that has the superior shape property including transferability, the superior workability, and the superior less-anisotropic property.

DISCLOSURE OF THE INVENTION

It is an object of the present invention as the first aspect thereof to provide a method for manufacturing cold-rolled steel sheet for deep drawing, which cold-rolled steel sheet is suitable for exterior sheets of automobiles and the like, has excellent press-formability, and gives less variations in press-formability in a coil, being manufactured in an industrially stable state.

To achieve the object, the present invention provides a method for manufacturing cold-rolled steel sheet comprising the steps of:

(a) providing a slab consisting essentially of 0.02% or less C, 0.5% or less Si, 2.5% or less Mn, 0.10% or less P, 0.05% or less S, 0.003% or less O, 0.003% or less N, 0.01 to 0.40% at least one element selected from the group consisting of Ti, Nb, V, and Zr, by weight, and balance being Fe;

(b) rough-rolling the slab by rough-rolling mill to form a sheet bar;

(c) finish-rolling the sheet bar by a continuous hot finish-rolling mill to form a hot-rolled steel strip, the finish-rolling comprising finish-rolling the sheet bar so that the material temperature at the final stand of the finish-rolling mill becomes $Ar_3$ transformation point or more over the whole range of from the front end of the sheet bar to the rear end thereof;

(d) cooling the hot-rolled steel strip on a runout table and coiling the cooled hot-rolled steel strip, the cooling on the runout table beginning within a time range of from more than 0.1 second and less than 1.0 second after completed the finish-rolling, the cooling on the runout table being conducted at the average cooling speed in a temperature range of from the hot-rolling finish temperature to 700° C. being 120° C./sec or more, the average cooling speed in a temperature range of from 700° C. to the coiling temperature being 50° C./sec or less, the coiling temperature of the hot-rolled steel strip being less than 700° C.; and (e) applying pickling and cold rolling the hot-rolled steel strip, and final annealing to the cold-rolled steel strip.

It is another object of the present invention as the second aspect thereof to provide a method for manufacturing cold-rolled steel sheet having superior shape property, workability, and less-anisotropic property in a stable state.

To achieve the object, the present invention provides a method for manufacturing cold-rolled steel sheet comprising the steps of:

(a) heating a slab consisting essentially of 0.0003 to 0.004% C, 0.05% or less Si, 0.05 to 2.5% Mn, 0.003 to 0.1% P, 0.0003 to 0.02% S, 0.005 to 0.1% sol.Al, 0.0003 to 0.004% N, by weight, and balance of Fe;

(b) hot-rolling the slab to form a hot-rolled steel strip; and (c) cold-rolling the hot-rolled steel strip to form a cold-rolled steel strip and annealing the cold-rolled steel strip, the step of hot-rolling comprising finish-rolling, cooling, and coiling, the finish-rolling having a total reduction in thickness of two passes before the final pass being in a range of from 25 to 45%, a reduction in thickness at the final pass being in a range of from 5 to 25%, and a finishing temperature being in a range of from the $Ar_3$ transformation point to the ($Ar_3$ transformation point+50° C.), and the cooling being carried out by a rapid cooling at a cooling speed in a range of from 200 to 2,000° C./sec within 1 second after completing the finish rolling, the temperature reduction from the finish temperature of the finish rolling in the rapid cooling being in a range of from 50 to 250° C., and the temperature to stop the rapid cooling being in a range of from 650 to 850° C., followed by applying slow cooling or air cooling at a rate of 100° C./sec or less.

To achieve the object, the present invention further provides a method for manufacturing cold-rolled steel sheet comprising the steps of:

(a) heating a slab consisting essentially of 0.0003 to 0.004% C, 0.05% or less Si, 0.05 to 2.5% Mn, 0.003 to 0.1% P, 0.0003 to 0.02% S, 0.005 to 0.1% sol.Al, 0.0003 to 0.004% N, by weight, and balance of Fe;

(b) hot-rolling the heated slab to form a hot-rolled steel strip; and (c) cold-rolling the hot-rolled steel strip to form a cold-rolled steel sheet and annealing the cold-rolled steel sheet;

the step of hot-rolling comprising finish-rolling, cooling, and coiling, the total reduction in thickness of two passes before the final pass being in a range of from 45 to 70%, the reduction in thickness at the final pass being in a range of from 5 to 35%, and the finish temperature being in a range of from the $Ar_3$ transformation point to the ($Ar_3$ transformation point+50° C.), and the cooling being carried out by a rapid cooling at a cooling speed of from 200 to 2,000° C./sec within 1 second after completing the finish rolling, the temperature reduction from the finish temperature of the finish-rolling in the rapid cooling being in a range of from 50 to 250° C., and the temperature to stop the rapid cooling being in a range of from 650 to 850° C., followed by applying slow cooling or air cooling at a rate of 100° C./sec or less.

DESCRIPTION OF THE EMBODIMENTS

Best mode 1

Figure 1:
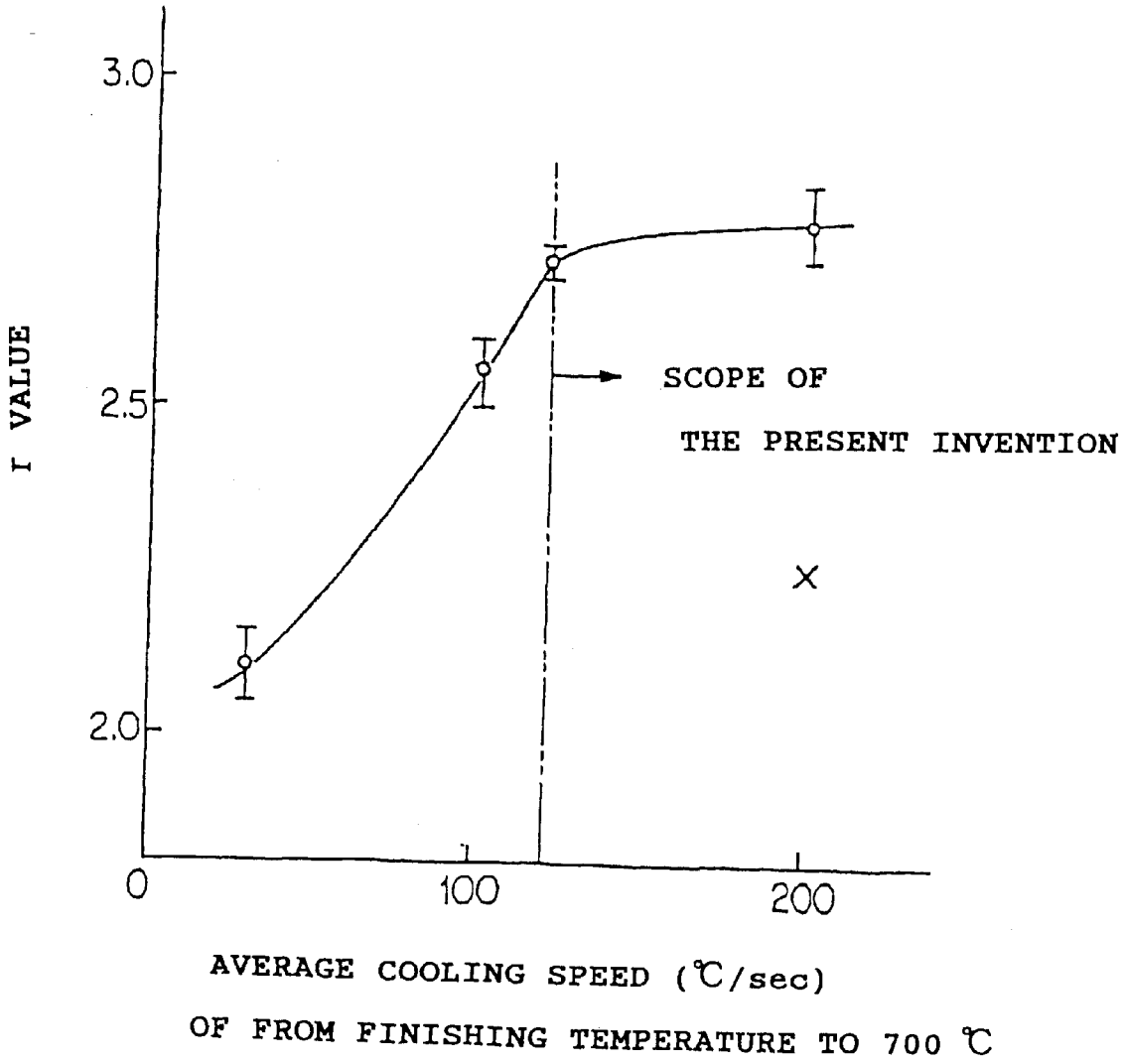
FIG. 1 is a graph showing the relation between the r value and the average cooling speed over the range of from the hot-rolling finish temperature to 700° C.

The inventors of the present invention developed a method for manufacture a cold-rolled steel sheet for deep drawing suitable for the exterior sheets for automobiles and the like with favorable press-formability and sheet shape property while giving less variations in press-formability in a coil. The method comprises the optimization of the composition of steel as the base material, and the optimization of hot-rolling condition and succeeding cooling and coiling conditions. In concrete terms, selection is made to a specified range of respective conditions of: the finish temperature in longitudinal direction of the material during finish-rolling of a sheet bar, obtained from the rough-rolling, using a continuous hot finish-rolling mill; the time to start cooling and the cooling speed on the runout table after the finish-rolling; the coiling temperature after the cooling; further preferably the reduction in thickness at the final stand of the finish-rolling mill, and other variables.

Furthermore, the inventors of the present invention found that, to obtain a cold-rolled steel sheet for deep drawing having particularly excellent performance, the heating of sheet bar before the finish-rolling and during the finish-rolling, particularly the heating of edge portions in the width direction of the sheet bar, is effective, adding to the above-described manufacturing conditions, and further the accelerated rolling in the finish-rolling step is effective.

The Best mode 1 was derived on the basis of the above-described findings, and is a method for manufacturing cold-rolled steel sheet for deep drawing having the features given below.

[1] The method for manufacturing cold-rolled steel sheet for deep drawing comprises the following-given steps. A slab of a steel consisting essentially of 0.02% or less C, 0.5% or less Si, 2.5% or less Mn, 0.10% or less P, 0.05% or less S, 0.003% or less O, 0.003% or less N, 0.01 to 0.40% at least one element selected from the group consisting of Ti, Nb, V, and Zr, by weight, is roughly rolled by a rough-rolling mill, in as-of continuously cast state or after heating the slab to a specified temperature after cooled, to form a sheet bar. The sheet bar is finish-rolled in a continuous hot finish-rolling mill to prepare a hot-rolled steel strip. Then the steel strip is cooled on a runout table, followed by coiling thereof. Then, the hot-rolled steel strip is subjected to a sequential order of at least pickling, cold-rolling, and final annealing.

The method is to manufacture a cold-rolled steel sheet for deep drawing providing superior press-formability and less variations of press-formability in a coil.

In the finish-rolling of the sheet bar at the continuous hot finish-rolling mill, the material temperature at the final stand of the finish-rolling mill is regulated to maintain $Ar_3$ transformation point or more over the whole range of from the front end of the sheet bar to the rear end thereof. The cooling on the runout table begins within a time range of from more than 0.1 second and less than 1.0 second after completed the finish-rolling. The cooling on the runout table is conducted at not less than 120° C./sec of the average cooling speed over a temperature range of from the hot-rolling finish temperature to 700° C., and not higher than 50° C./sec of the average cooling speed over a temperature range of from 700° C. to the coiling temperature, and the coiling temperature of the hot-rolled steel strip is less than 700° C.

[2] In the manufacturing method [1], the slab being hot-rolled further contains 0.0001 to 0.005% B by weight to manufacture a cold-rolled steel sheet for deep drawing providing superior press-formability and less variations of press-formability in a coil.

[3] In the manufacturing method [1] or [2], the finish-rolling is conducted at reduction in thicknesses ranging from more than 5% to less than 30% at the final stand of the finish-rolling mill to manufacture a cold-rolled steel sheet for deep drawing providing superior press-formability and less variations of press-formability in a coil.

[4] In either one of the manufacturing methods [1] through [3], the rolling is carried out so as the material temperature at the final stand of the finish-rolling mill to become a range of from $Ar_3$ transformation point to ($Ar_3$ transformation point+50° C.) over the whole range of from the front end of the sheet bar to the rear end thereof to manufacture a cold-rolled steel sheet for deep drawing providing superior press-formability and less variations of press-formability in a coil.

[5] In either one of the manufacturing methods [1] through [3], the rolling is carried out so as the material temperature at the final stand of the finish-rolling mill to become a range of from $Ar_3$ transformation point to ($Ar_3$ transformation point+40° C.) over the whole range of from the front end of the sheet bar to the rear end thereof to manufacture a cold-rolled steel sheet for deep drawing providing superior press-formability and less variations of press-formability in a coil.

[6] In either one of the manufacturing methods [1] through [5], on finish-rolling the sheet bar, the sheet bar is heated using a heating unit which is placed at inlet of the continuous hot finish-rolling mill and/or between the finish-rolling mill stands to manufacture a cold-rolled steel sheet for deep drawing providing superior press-formability and less variations of press-formability in a coil.

[7] In the manufacturing method [6], the sheet bar is heated by a heating unit at edge portions in width direction of the sheet bar to manufacture a cold-rolled steel sheet for deep drawing providing superior press-formability and less variations of press-formability in a coil.

[8] In either one of the manufacturing methods [6] or [7], the heating unit is an induction heating unit to manufacture a cold-rolled steel sheet for deep drawing providing superior press-formability and less variations of press-formability in a coil.

[9] In either one of the manufacturing methods [1] through [8], the rolling speed of the roughly-rolled steel bar is accelerated after the front end of the sheet bar entered into the continuous hot finish-rolling mill, followed by maintaining or further accelerating the rolling speed to manufacture a cold-rolled steel sheet for deep drawing providing superior press-formability and less variations of press-formability in a coil.

The detail of the Best mode 1 and the reasons of limiting the conditions thereof are described in the following.

First, the composition of the steel slab for hot-rolling and the reasons of limiting the composition are given below.

The slab being hot-rolled is a steel containing: 0.02% or less C, 0.5% or less Si, 2.5% or less Mn, 0.10% or less P, 0.05% or less S, 0.003% or less O, 0.003% or less N, 0.01 to 0.40% at least one element selected from the group consisting of Ti, Nb, V, and Zr, by weight, and, at need, further containing 0.0001 to 0.005% B.

Since C is an element that gives bad influence on the deep drawing performance, less content thereof is preferred. If the C content exceeds 0.02%, the deep drawing performance that is a target of the present invention cannot be attained. Accordingly, the content of C is specified to 0.02% or less. For further improving the deep drawing performance, the C content is preferably to limit to 0.0020% or less. For further improving the workability, the C content is preferably to limit to 0.0014% or less.

Silicon has a function to strengthen the steel sheet by forming solid solution. Since, however, Si is an element that gives bad influence on the deep drawing performance, less content of Si is preferred. If the Si content exceeds 0.5%, the plating performance and the deep drawing performance are degraded. Therefore, the Si content is limited to 0.5% or less (including the case of non-addition of Si). For further improving the plating performance, the Si content is preferred to limit to 0.1% or less. For further increasing the workability, the Si content is preferred to limit to 0.03% or less.

Manganese has functions to improve toughness of steel sheet and to strengthen the steel by forming solid solution. On the other hand, Mn is an element that gives bad influence on the workability. If the Mn content exceeds 2.5%, the strength of steel increases to significantly reduce the deep drawing performance. Consequently, the Mn content is limited to 2.5% or less (including the case of non-addition of Mn). For further improving the deep drawing performance, the Mn content is preferred to limit to 2.0% or less. For further increasing the workability, the Mn content is preferred to limit to 0.5% or less.

Phosphorus has a function to strengthen the steel by forming solid solution. If the P content exceeds 0.10%, however, grain boundary brittleness likely occurs caused from grain boundary segregation, and the ductility also degrades. Consequently, the P content is limited to 0.10% or less (including the case of non-addition of P). For further improving the ductility, the P content is preferred to limit to 0.05% or less. For further increasing the ductility, the P content is preferred to limit to 0.02% or less. For attaining the best ductility level, the P content is preferred to limit to 0.007% or less.

If the S content exceeds 0.05%, the precipitate quantity of sulfide increases, thus degrading the deep drawing performance and the ductility. Therefore, the S content is limited to 0.05% or less (including the case of non-addition of S). For further improving the workability, the S content is preferred to limit to 0.02% or less, and for further increasing the workability, the S content is preferred to limit to 0.010% or less.

Less N content is economical because the added amount of carbo-nitride-forming elements, which are described later, becomes less. If the N content exceeds 0.003%, the degradation of workability of steel sheet is unavoidable even when carbo-nitride-forming elements are added to fix the nitrogen. Consequently, the N content is limited to 0.03% or less (including the case of non-addition of N). For further improving the workability, the N content is preferred to limit to 0.0019% or less.

Less O content is preferable in view of workability. If the O content exceeds 0.003%, the degradation of workability of steel sheet inevitably occurs. Accordingly, the O content is limited to 0.003% or less (including the case of non-addition of O).

Adding to the above-described elements, the slab further contains 0.01 to 0.40% of at least one element selected from the group consisting of Ti, Nb, V, and Zr. The additional elements decrease the quantity of C, N, and S in the steel by forming their respective carbo-nitride and sulfide, thus further improving the workability. Accordingly, these elements are added separately or in combination of two or more kinds thereof. If, however, the sum of these additional elements is less than 0.01%, the wanted effect cannot be attained. And, if the sum of these additional elements exceeds 0.40%, the strength excessively increases to degrade the workability. Thus, the added content of the sum of these additional elements is limited to a range of from 0.01 to 0.40%.

In the Best mode 1, B may further be added in a range of from 0.0001 to 0.005% to improve the resistance to longitudinal breakage. On adding B, if the B content is less than 0.0001%, the effect of improving the resistance to longitudinal breakage cannot be attained, and, if the B content exceeds 0.0050%, the effect saturates to lose the economical satisfaction. Therefore, the B content, if it is added, is limited to a range of from 0.0001 to 0.005%.

As the balance components in the steel slab, Fe and inevitable impurity elements may exist, other elements may further be existed as far as they do not degrade the effect of the present invention.

The following is the manufacturing conditions and the reasons of the limitation of these conditions for the Best mode 1.

According to the Best mode 1, the steel having the composition above-described is roughly rolled in a rough-rolling mill as-of continuous cast state or after heating the slab to a specified temperature after cooled to form a sheet bar. The sheet bar is finish-rolled in a continuous hot finish-rolling mill to prepare a hot-rolled steel strip. Then the steel strip is cooled on a runout table, followed by coiling thereof. Then, the hot-rolled steel strip is subjected to a sequential order of at least pickling, cold-rolling, and final annealing. The above-described hot-rolling and succeeding cooling and coiling are conducted under the conditions given below.

The as-of continuously cast slab referred in the Best mode 1 includes the slab which was continuously cast without subjected to any treatment, and the slab which was subjected to soaking or light heating by a heating unit after the casting or before the hot-rolling. The slab heated to a specified temperature after cooled referred in the Best mode 1 includes the slab which was reheated to a specified temperature in a hot-rolling heating furnace after cast and cooled to room temperature, and the slab which was cooled to a temperature higher than the room temperature after the casting, followed by heating thereof to a specified temperature by a hot-rolling heating furnace or the like.

First, in the finish-rolling of the sheet bar at the continuous hot finish-rolling mill, the material temperature (or the finish temperature) at the final stand of the finish-rolling mill is regulated to maintain $Ar_3$ transformation point or higher temperature over the whole range of from the front end of the sheet bar to the rear end thereof. The rolling brings the level of r value and of ductility (breaking elongation) in a coil, (or the level of these characteristics including the variations in the coil width and longitudinal directions), into the scope of the present invention. By conducting rolling so as the material temperature over the whole range of from the front end of the sheet bar to the rear end thereof at the final stand of the finish-rolling mill to become a range of from $Ar_3$ transformation point to ($Ar_3$ transformation point+50° C.), preferably from $Ar_3$ transformation point to ($Ar_3$ transformation point+40° C.), a steel sheet having more excellent deep drawing performance and less variations of mechanical properties in a coil (in the coil width and longitudinal directions) is attained.

As a more preferred condition for manufacturing steel sheet, adding to the control of material temperature (finish temperature) at the final stand of the finish-rolling mill, the rolling is conducted by regulating the temperature over the whole range of from the front end of the sheet bar to the rear end thereof at one or more stands before the final stand of the finish-rolling mill, preferably regulating the temperature at individual stands, in a temperature range of from $Ar_3$ transformation point to ($Ar_3$ transformation point+30° C.). The condition allows to manufacture a steel sheet having further excellent deep drawing performance and further small variations in mechanical properties in a coil (in the width and longitudinal directions).

The reduction in thickness at the final stand of the finish-rolling mill is preferably 5% or more to decrease the grain size in the structure of the hot-rolled steel sheet to obtain the effect of the present invention. On the other hand, to hold the coil shape in a good state, the reduction thickness is preferred to limit to less than 30%. If the reduction in thickness at the final stand of the finish-rolling mill is 30% or more, the travel of the sheet becomes unstable, and insufficient shape of sheet likely occurs.

Within a time range of from longer than 0.1 second and shorter than 1.0 second after completed the finish-rolling, the cooling on the runout table starts. By starting the cooling on the runout table within less than 1.0 second after completing the finish-rolling, the growth of austenitic grains after the finish-rolling and before the transformation can be suppressed, thus attaining the superior press-formability satisfying the scope of the Best mode 1. To obtain further excellent r value, the time to start cooling on the runout table after completing the finish-rolling is preferably selected to 0.8 second or less. For further effectively attaining the effect of the Best mode 1, shorter time between the completion of the finish-rolling and the time to start cooling on the runout table is more preferable. However, the time to start cooling on the runout table of 0.1 second or less is difficult to be actualized because of the limitation of layout in an actual facility, (the cooling unit cannot be installed directly adjacent to the exit of the final stand of the finish-rolling mill because the instruments are necessary to be located adjacent to the place.) For suppressing dispersion of the breaking elongation to smaller level, it is preferable that the time to start cooling on the runout table after the completion of finish-rolling is set to longer than 0.5 second.

The cooling on the runout table is carried out at average cooling speeds of 120° C./sec or more in a range of from the hot-rolling finish temperature to 700° C. With the average cooling speed level, even if the time to start cooling on the runout table after the completion of the finish-rolling is longer than 0.1 second and shorter than 1.0 second, the frequency of generation of ferritic nuclei during the austenite-ferrite transformation period increases to reduce the ferritic grain sizes, thus attaining the excellent press-formability satisfying the scope of the present invention. If the average cooling speed is less than 120° C./sec, the above-described frequency of generation of ferritic nuclei becomes low, and the press-formability targeted by the Best mode 1 cannot be attained.

FIG. 1 shows the relation between the average cooling speed in a range of from the hot-rolling finish temperature to 700° C. during the hot-rolling of a continuous cast slab having the composition of No. 1 steel in Table 1 and the r value (mean r value) of the cold-rolled steel sheet after the final annealing. According to the hot-rolling conditions of the Table, for the case that the time between the completion of finish-rolling and the start of cooling on the runout table is 1.3 second, which is outside of the scope of the present invention, (the other hot-rolling conditions are within the scope of the present invention), only low r values are acquired even if the average cooling speed during the range of from the hot-rolling finish temperature to 700° C. is 120° C./sec or more. These states are expressed by (x) mark in FIG. 1. To the contrary, as of the hot-rolling conditions, when the time between the completion of finish-rolling and the start of cooling on the runout table, the average cooling speed over the range of from 700° C. to the coiling temperature, and the coiling temperature are within the scope of the present invention, high r values are attained even when the average cooling speed over the range of from the hot-rolling finish temperature to 700° C. is 120° C./sec or more. These states are expressed by (O) mark in FIG. 1.

Furthermore, the above-described cooling on the runout table is carried out at average cooling speeds of 50° C./sec or less over the range of from 700° C. to the coiling temperature. This allows the precipitates such as carbide formed in the steel to grow to coarse ones, and the growth of grains during the recrystallization annealing is improved. If the average cooling speed over the range of from 700° C. to the coiling temperature exceeds 50° C./sec, the above-described precipitates cannot grow to coarse ones, and the growth of grains during the recrystallization annealing cannot be enhanced.

The hot-rolled steel sheet which was cooled on the runout table under the above-described condition is coiled at temperatures of less than 700° C. By adjusting the coiling temperature to below 700° C., the generation of coarse grains resulted from growth of ferritic grains can be suppressed. If the coiling temperature becomes 700° C. or above, the generation of coarse grains caused from the growth of ferritic grains hinders the acquisition of press-formability targeted by the Best mode 1.

The hot-rolled steel strip thus prepared is subjected to at least pickling, cold-rolling, and final annealing in this sequence, thus providing a cold-rolled steel sheet having superior press-formability and less variations of press-formability in a coil.

The above-described cold-rolling is applied to develop a rolled texture to develop a texture preferable for improving the workability during the final annealing (recrystallization annealing). For this purpose, the cold-rolling is preferably carried out at reduction in thicknesses of 50% or more, more preferably 76% or more, down to the final sheet thickness.

The above-described final annealing (recrystallization annealing) is preferably conducted at annealing temperatures of from 550 to 900° C. (of the ultimate sheet temperature), which makes the ferritic grains recrystallize. If the annealing temperature is less than 550° C., the recrystallization is not fully performed even in a box annealing for a long period. If the annealing temperature exceeds 900° C., the austenite-formation proceeds even in continuous annealing, thus degrading the workability. The method for conducting recrystallization annealing may be either one of continuous annealing, box annealing, and continuous annealing prior to hot-dip galvanization. After the annealing, temper rolling may be applied.

The following is the description of more preferable mode of the Best mode 1.

According to the Best mode 1, the sheet bar obtained from the rough-rolling is subjected to the finish-rolling. In that process, the whole range of the sheet bar and/or the edges in the width direction of the sheet bar are heated before the finish-rolling and/or during the finish-rolling, thus further improving the uniformity of press-formability in a coil having superior press-formability. To do this, it is preferable that a heating unit is positioned at inlet of the continuous hot finish-rolling mill and/or between the stands to heat the whole range of the sheet bar and/or the edges in the width direction of the sheet bar.

As of these means, it is more preferable to heat the edge portions in the width direction of the sheet bar using a heating unit (edge heater). By heating the edge portions of the sheet bar, the temperature dispersion in the width direction of the sheet bar becomes less, and the dispersion of grain sizes in the hot-rolled steel strip becomes less. As a result, the uniformity of press-formability in a coil is further improved.

As a heating unit to heat the whole range of the sheet bar and/or the edge portions in the width direction thereof, it is particularly preferred to apply an induction heating unit in view of the controllability of heating temperature.

The heating of the sheet bar, which is described above, can be effectively performed also in a continuous hot-rolling process using a coil box or the like. The heating of sheet bar in this case may be conducted either one or more of before or after the feeding into the coil box, between the stands of the rough-rolling mill, and exit of the rough-rolling mill. Alternatively, the heating of the sheet bar may be given before or after the welding machine succeeding to the coil box.

To further adequately and reasonably obtain the cold-rolled steel sheet having the performance targeted by the Best mode 1, it is preferable that the rolling speed of the sheet bar in the above-described finish-rolling is accelerated after the front end of the sheet bar entered the finish-rolling mill, then the rolling speed is held at a constant speed or further accelerated. By applying the finish-rolling under the condition, the temperature reduction in the sheet bar can be suppressed. As a result, the variations of press-formability in a coil caused from the material temperature reduction can be suppressed. In addition, the energy consumption of the heating unit (such as the induction heating unit) for heating the sheet bar inserted at inlet side of the finish-rolling mill or between the stands can be reduced.

The sheet bar is preferably subjected to shape-leveling before the finish-rolling using a leveling unit such as a leveler. The leveling step may be applied before or after the heating step in the case of heating the whole range of the sheet bar and/or the edges in the width direction of the sheet bar before the finish rolling.

If the leveling step is applied before the above-described heating step for the sheet bar, the sheet bar gives good uniformity of heating because the heating is carried out after establishing a good shape of the sheet bar by the leveling, thus the homogeneity of structure in the sheet bar is improved. Furthermore, since the shape of the sheet bar fed to the finish-rolling mill is in a good state, the uniformity under the plastic deformation in the finish-rolling becomes better, thus the microstructure of the obtained steel sheet becomes homogeneous.

Also in the case that the shape-leveling is given after the heating step for the sheet bar, the shape of the sheet bar fed to the finish-rolling mill becomes good, thus the uniformity under the plastic deformation during the finish-rolling becomes better, which results in homogeneous microstructure of the obtained steel sheet.

The steel as the base material in the Best mode 1 is prepared by a converter, an electric furnace, or the like. The slab manufacture may be carried out by either one of the ingot-bloom rolling process, the continuous casting process, the thin slab casting process, and the strip casting process. The method for introducing that type of slab into the hot-rolling step may be either one of the processes: (1) a slab obtained from continuous casting or from ingot-bloom rolling is cooled to room temperature or an arbitrary temperature above the room temperature, then is fed to a hot-rolling furnace to heat thereof, followed by hot-rolling thereof, (including what is called the "ingot-feed rolling process"), and (2) a slab prepared by continuous casting is hot-rolled without applying additional treatment, (including the case of applying soaking or light-heating after the casting and before the hot-rolling). In the case of (1), the temperature of slab fed to the hot-rolling furnace is preferably at $Ar_3$ transformation point or lower temperature in view of controlling the structure.

The cold-rolled steel sheet prepared by the manufacturing method according to the Best mode 1 is subjected to, at need, adequate surface treatment (for example, hot dip galvanization, alloyed hot dip galvanization, electroplating, and organic coating), followed by press-working to serve as the base materials of automobiles, household electric appliances, steel structures, and the like. The cold-rolled steel sheet has high workability and strength required particularly in these uses.

EXAMPLE 1

Steels (No. 1 through No. 4) having chemical compositions given in Table 1 were melted and formed in a slab form. The slabs were hot-rolled under the conditions given in Table 2, then were cooled and coiled. Thus obtained hot-rolled steel sheets were subjected to pickling, and cold-rolling at 75% of reduction in thickness. The steel sheets were treated by final annealing at 850° C. for 40 seconds.

Thus obtained cold-rolled steel sheets were tested to determine mechanical properties (r value and elongation). Table 2 shows the results.

As seen in Table 2, the materials No. 1 through No. 5, which are the Examples of the present invention, gave high r value and breaking elongation, showed superior press-formability and uniformity thereof. The material No. 5 showed particularly less dispersion in the breaking elongation, giving particularly excellent elongation.

To the contrary, the materials No. 6 through No. 9 gave lower r value level compared with that in the Examples of the present invention. The materials No. 6 and No. 7 showed the average cooling speed over the range of from the hot-rolling finish temperature to 700° C. below the lower limit specified by the present invention. The material No. 8 showed the average cooling speed over the range of from 700° C. to the coiling temperature above the upper limit specified by the present invention. The material No. 9 showed the time to start cooling on the runout table above the upper limit specified by the present invention.

TABLE 1

| Steel | Chemical composition (wt. %) | | | | | | | | | |
|---|---|---|---|---|---|---|---|---|---|---|
| No. | C | Si | Mn | S | P | O | N | Ti | Nb | B |
| 1 | 0.0018 | 0.01 | 0.16 | 0.008 | 0.017 | 0.0024 | 0.0017 | 0.035 | — | 0.0005 |
| 2 | 0.0014 | 0.01 | 0.60 | 0.005 | 0.050 | 0.0020 | 0.0012 | 0.033 | — | — |
| 3 | 0.0065 | 0.01 | 0.21 | 0.004 | 0.010 | 0.0019 | 0.0038 | 0.032 | 0.080 | — |
| 4 | 0.0018 | 0.01 | 0.20 | 0.008 | 0.012 | 0.0026 | 0.0028 | 0.007 | 0.025 | — |

Note) Steel Nos. 1 to 4 satisfy the condition of the present invention.

TABLE 2

| Material No. | Steel No. *1 | Hot-rolling finish temperature (° C.) *2 | Time between the completion of the finish-rolling and the start of the cooling on runout table (sec) | Average cooling speed between the hot-rolling finish temperature and 700° C. (° C./sec) | Average cooling speed between 700° C. and the coiling temperature (° C./sec) | Coiling temperature (° C.) | Variations of characteristics within hot-rolled steel sheet *3 r value | EI (%) | Classification |
|---|---|---|---|---|---|---|---|---|---|
| 1 | 1 | $(Ar_3) \sim (Ar_3 + 20)$ | 0.15 | 120 | 10 | 640 | 2.70 ~ 2.75 | 50.1 ~ 51 8 | E |
| 2 | 1 | $(Ar_3) \sim (Ar_3 + 35)$ | 0.15 | 200 | 15 | 642 | 2.73 ~ 2.85 | 50.9 ~ 51.4 | E |
| 3 | 2 | $(Ar_3 + 5) \sim (Ar_3 + 35)$ | 0.15 | 205 | 10 | 645 | 2.79 ~ 2.90 | 51.1 ~ 51.7 | E |
| 4 | 3 | $(Ar_3 + 5) \sim (Ar_3 + 35)$ | 0.3 | 203 | 5 | 640 | 2.70 ~ 2.81 | 50.9 ~ 51.7 | E |
| 5 | 4 | $(Ar_3) \sim (Ar_3 + 24)$ | 0.6 | 151 | 5 | 683 | 2.71 ~ 2.75 | 51.5 ~ 51.7 | E |
| 6 | 1 | $(Ar_3 + 3) \sim (Ar_3 + 28)$ | 0.15 | 100 | 20 | 682 | 2.52 ~ 2.60 | 50.5 ~ 51.9 | C |
| 7 | 1 | $(Ar_3 + 4) \sim (Ar_3 + 21)$ | 0.15 | 30 | 20 | 684 | 2.05 ~ 2.16 | 50.4 ~ 51.6 | C |
| 8 | 1 | $(Ar_3 + 5) \sim (Ar_3 + 20)$ | 0.15 | 204 | 75 | 681 | 2.43 ~ 2.55 | 50.5 ~ 51.4 | C |
| 9 | 1 | $(Ar_3 + 5) \sim (Ar_3 + 21)$ | 1.3 | 200 | 25 | 641 | 2.21 ~ 2.30 | 49.0 ~ 49.8 | C |

※ Figures with underline are out of the scope of the present invention.
*1 Steel No. in TABLE 1.
*2 Material temperature at the final stand of the finish-rolling mill over the range of from the front end of the sheet bar to the rear end thereof.
*3 Characteristics in the coil width direction were determined from the samples collected from three points: top, middle, and bottom in the longitudinal direction of the hot-rolled steel sheet, and the variations of the maximum values and minimum values of thus collected data were defined as the range of respective characteristics.
C: Comparative example
E: Example

EXAMPLE 2

Steels (No. 1 through No. 4) having chemical compositions given in Table 1 were prepared in a slab form. The slabs were hot-rolled under the conditions given in Table 3, then were cooled and coiled. Thus obtained hot-rolled steel sheets were subjected to pickling, and cold-rolling at 75% of reduction in thickness. The steel sheets were treated by final annealing at 850° C. for 40 seconds.

Thus obtained cold-rolled steel sheets were tested to determine mechanical properties (r value and elongation). Table 3 shows the results.

As seen in Table 3, the materials No. 1 through No. 6, which are the Examples of the present invention, gave high r value and breaking elongation, showed superior press-formability and uniformity thereof, and gave good sheet shape. Particularly when the comparison between steels having the same composition to each other is given, the materials No. 1 and No. 2 which have less dispersion in the rolling finish temperature over the whole range of from the front end of the sheet bar to the rear end thereof showed higher r value than that of the material No. 6 which has relatively large dispersion of the hot-rolling finish temperature, thus the materials No. 1 and No. 2 have superior performance to the material No. 6. The material No. 5 has particularly small dispersion in the breaking elongation, and is superior in elongation characteristic.

To the contrary, the materials No. 7 through No. 10 gave lower r value than that in the Examples of the present invention. The material No. 7 and No. 8 showed the average cooling speed over the range of from the hot-rolling finish temperature to 700° C. below the lower limit specified by the present invention, (the material No. 7 gave a reduction in thickness at the final stand of the finish rolling mill above the upper limit of preferable level specified by the present invention). The material No. 9 showed the average cooling speed over the range of from 700° C. to the coiling temperature above the upper limit specified by the present invention. The material No. 10 showed the time to start cooling on the runout table above the upper limit specified by the present invention. The material No. 7 gave large edge wave and inferior sheet shape.

TABLE 3

| Material No. | Steel No. *1 | Final finish reduction in thickness (%) *2 | Hot-rolling finish temperature (° C.) *3 | Time between the completion of the finish-rolling and the start of the cooling on runout table (sec) | Average cooling speed between the hot-rolling finish temperature and 700 ° C. (° C./sec) | Average cooling speed between 700° C. and the coiling temperature (° C./sec) | Coiling temperature (° C.) | Variations of characteristics within hot-rolled steel sheet *4 | | Sheet shape | Classification |
|---|---|---|---|---|---|---|---|---|---|---|---|
| | | | | | | | | r value | El (%) | | |
| 1 | 1 | 10 | $(Ar_3) \sim (Ar_3 + 20)$ | 0.15 | 120 | 10 | 640 | 2.70 ~ 2.75 | 50.1 ~ 51.8 | Good | E |
| 2 | 1 | 10 | $(Ar_3) \sim (Ar_3 + 35)$ | 0.15 | 200 | 15 | 642 | 2.73 ~ 2.85 | 50.9 ~ 51.4 | Good | E |
| 3 | 2 | 25 | $(Ar_3 + 5) \sim (Ar_3 + 35)$ | 0.15 | 205 | 10 | 645 | 2.79 ~ 2.90 | 51.1 ~ 51.7 | Good | E |
| 4 | 3 | 20 | $(Ar_3 + 5) \sim (Ar_3 + 35)$ | 0.3 | 203 | 5 | 640 | 2.70 ~ 2.81 | 50.9 ~ 51.7 | Good | E |
| 5 | 4 | 20 | $(Ar_3) \sim (Ar_3 + 24)$ | 0.6 | 151 | 5 | 683 | 2.71 ~ 2.75 | 51.5 ~ 51.7 | Good | E |
| 6 | 1 | 10 | $(Ar_3) \sim (Ar_3 + 50)$ | 0.15 | 200 | 15 | 640 | 2.68 ~ 2.72 | 50.0 ~ 51.0 | Good | E |
| 7 | 1 | 35 | $(Ar_3 + 3) \sim (Ar_3 + 28)$ | 0.15 | 100 | 20 | 682 | 2.52 ~ 2.60 | 50.5 ~ 51.9 | Bad (Significant edge waving) | C |
| 8 | 1 | 10 | $(Ar_3 + 4) \sim (Ar_3 + 21)$ | 0.15 | 30 | 20 | 684 | 2.05 ~ 2.16 | 50.4 ~ 51.6 | Good | C |
| 9 | 1 | 10 | $(Ar_3 + 5) \sim (Ar_3 + 20)$ | 0.15 | 204 | 75 | 681 | 2.43 ~ 2.55 | 50.5 ~ 51.4 | Good | C |
| 10 | 1 | 10 | $(Ar_3 + 5) \sim (Ar_3 + 21)$ | 1.3 | 200 | 25 | 641 | 2.21 ~ 2.30 | 49.0 ~ 49.8 | Good | C |

※ Figures with underline are out of the scope of the present invention.
*1 Steel No. in TABLE 1.
*2 Reduction at the final stand of the finish-rolling mill.
*3 Material temperature at the final stand of the finish-rolling mill over the range of from the front end of the sheet bar to the rear end thereof.
*4 Characteristics in the coil width direction were determined from the samples collected from three points: top, middle, and bottom in the longitudinal direction of the hot-rolled steel sheet, and the variations of the maximum values and minimum values of thus collected data were defined as the range of respective characteristics.
C: Comparative example
E: Example Best mode 2

Investigation conducted by the inventors of the present invention revealed that the technology which was proposed by Kino et al. and the technologies disclosed in the above-described Japanese Patent Publications cannot improve the mechanical properties (r value and elongation) unless the temperature reduction during rapid cooling and the temperature to stop cooling are controlled in a favorable range. That is, experiments which were carried out by the inventors of the present invention based on these technologies told that, if the temperature reduction during rapid cooling or the temperature to stop cooling is outside of respective favorable ranges, the elongation cannot be improved even when the average r value is high, and inversely the elongation may degrade, further the average r value may also degrade. In other words, excessive cooling by the rapid cooling gives bad influence on the mechanical properties, and the improvement of material quality cannot be attained solely by rapid cooling to cool over a wide temperature range including a specified temperature range, (or the temperature range extended to lower temperature side). Furthermore, when the work strain is accumulated to a large quantity aiming to reduce the grain size, bad influence is induced on the transferability and the shape property of the steel sheet.

To this point, the inventors of the present invention carried out study to solve the problems, and found that, in a composition on the basis of very low carbon steel, the control of hot-rolling drafting conditions and further the control of conditions for cooling the hot-rolled steel on the runout table provide a cold-rolled steel sheet having superior shape property and having further significantly excellent workability and less-anisotropic property than ever. That is, adding to the adjustment of the steel composition to a specific composition of very low carbon steel group, the following-described findings were derived.

(1) Regarding the drafting condition in the hot-rolling step, adequate setting of the reduction in thickness at the final pass of the finish-rolling and the reduction in thickness during the two passes before the final pass lead favorable shape property of the steel sheet and favorable transferability of the hot-rolled steel sheet during the manufacturing process, and allow the work strain in hot-working increase within a range of inducing no problem to attain fine grain size formation.

(2) To begin the rapid cooling as promptly as possible after the completion of the finish-rolling is effective for reducing the grain size in the hot-rolled steel sheet and for improving the mechanical properties.

(3) By adequately setting the range of temperature reduction caused from the above-described rapid cooling, the excessive cooling by the rapid cooling can be suppressed, and the workability such as elongation and deep drawing performance and the less-anisotropic property can be improved.

(4) By adequately setting the temperature to stop cooling in the above-described rapid cooling, the target fine structure can be attained.

(5) By making the cooling after the rapid cooling step to a slow cooling speed, the formation of adequate polygonal ferritic grains can be realized.

The Best mode 2 has been derived based on the above-described findings, and is a method for manufacturing cold-rolled steel sheet having superior shape property and workability, and less-anisotropic property, as described above.

[1] A slab consisting essentially of 0.0003 to 0.004% C, 0.05% or less Si, 0.05 to 2.5% Mn, 0.003 to 0.1% P, 0.0003 to 0.02% S, 0.005 to 0.1% sol.Al, 0.0003 to 0.004% N, by weight, is heated, hot-rolled, cold-rolled, and annealed to manufacture a cold-rolled steel sheet.

The method is to manufacture a cold-rolled steel sheet providing superior shape property and workability, and less-anisotropic property, wherein the hot-rolling comprises the steps of: applying the finish-rolling with the total reduction in thickness of two passes before the final pass in a range of from 25 to 45%, with the reduction in thickness at the final pass in a range of from 5 to 25%, and with the finish temperature in a range of from the $Ar_3$ transformation point to the ($Ar_3$ transformation point+50° C.), to the end of the finish-rolling; applying cooling by a rapid cooling with a starting cooling speed in a range of from 200 to 2,000° C./sec within 1 second after completing the finish rolling, the temperature reduction from the finish temperature of the finish-rolling in the rapid cooling being in a range of from 50 to 250° C., and the temperature to stop the rapid cooling being in a range of from 650 to 850° C.; applying slow cooling or air cooling to the steel strip at a rate of 100° C./sec or less; and applying coiling to thus obtained hot-rolled steel strip.

[2] In the manufacturing method [1], the slab further contains 0.005 to 0.1% by weight of at least one element selected from the group consisting of Ti, Nb, V, and Zr, as the sum thereof, to manufacture a cold-rolled steel sheet having superior shape property and workability, and having less anisotropic property.

[3] In the manufacturing method [1] or [2], the slab further contains 0.015 to 0.08% Cu, by weight, to manufacture a cold-rolled steel sheet having superior shape-formability and workability, and having less anisotropic property.

[4] In the manufacturing method [1], [2], or [3], the steel further contains 0.0001 to 0.001% B, by weight, to manufacture a cold-rolled steel sheet having superior shape property and workability, and having less anisotropic property.

In prior art, for example, JP-A-7-70650, JP-A-6-212354, and JP-A-6-17141, there are two expressions on specifying the temperature relating to $Ar_3$ transformation point: the one is to specify the temperature itself, describing, "finish temperature: $Ar_3$ transformation temperature or above.", and the other is to use the $Ar_3$ transformation point for specifying the temperature during cooling, describing, "rapidly cool from . . . to ($Ar_3$ transformation point−50° C.)". Since the increase in rapid cooling speed lowers the $Ar_3$ transformation point, the $Ar_3$ transformation point in the latter case differs from the $Ar_3$ transformation point in the former case, and always the $Ar_3$ transformation point in the former case gives lower temperature than that in the latter case. Nevertheless, many of the prior arts give understanding that the transformation point in the latter context is the same temperature with the transformation point in the former context, which is not theoretically correct. Furthermore, since higher cooling speed decreases further the $Ar_3$ transformation point, if the latter context signifies the $Ar_3$ transformation point, the actual value of the point cannot be identified in many cases. Consequently, the present invention specifies the temperature during the rapid cooling by numerals, not using vague expression of "$Ar_3$ transformation point".

The following is detail description of the method for manufacturing cold-rolled steel sheet according to the Best mode 2 in terms of the steel composition and the process conditions.

1. Steel composition

The composition of the steel according to the Best mode 2 contains: 0.0003 to 0.004% C, 0.05% or less Si, 0.05 to 2.5% Mn, 0.003 to 0.1% P, 0.0003 to 0.02% S, 0.005 to 0.1% sol.Al, and 0.0003 to 0.004% N, by weight. The steel may further contain, at need, 0.005 to 0.1% of at least one element selected from the group consisting of Ti, Nb, V, and Zr+ to improve the elongation and flange properties. The steel having either of above-specified compositions may further contain, at need, 0.015 to 0.08% Cu to reduce bad influence of the solid solution S. The steel having either one of above-specified compositions may further contain, at need, 0.0001 to 0.001% B to improve the longitudinal crack resistance of the steel.

The C content is specified to a range of from 0.0003 to 0.004%.

Less C content further improves the ductility and deep drawing performance. Nevertheless, the lower limit of C content is specified to 0.0003% taking into account of the current steel making conditions. If the C content is not more than 0.004%, the ductility and the deep drawing performance can be improved by fixing C using carbide-forming element (Ti, Nb, or the like) to form a steel in which no solid solution of interstitial elements exists, (or an IF steel (Interstitial-Free steel)). Therefore, the C content is specified to not more than 0.004%. If the C content is not more than 0.002%, the elongation and the deep drawing performance can be brought to higher level, thus the adding amount of carbide-forming elements is reduced. Accordingly, the C content is preferred to limit to 0.002% or less. Even if the C content is in a range of from 0.002 to 0.004%, however, the elongation and the deep drawing performance can be brought to higher level, and the anisotropic property can be suppressed to a low level by setting the coiling temperature to a high level.

The Si content is specified to 0.05% or less.

Silicon is an element that gives bad influence on the characteristics of mildness and high ductility, and an element that gives bad influence on the surface treatment of Zn plating or the like. Silicon is also used as a deoxidizing element. If the Si content exceeds 0.05%, the bad influence on the material quality and the surface treatment becomes significant. Consequently, the Si content is specified to 0.05% or less.

The Mn content is specified to a range of from 0.05 to 2.5%.

Manganese is an element that improves the toughness of steel, and that can be effectively used for strengthening solid solution. However, excessive addition of Mn gives bad influence on the workability. In addition, Mn can be effectively used for precipitating S as MnS. The present invention specifies the Mn content to 2.5% or less emphasizing to provide high elongation and deep drawing performance, and also utilizing thereof for strengthening the steel. By taking into account of the cost for removing S during the steel making process, the lower limit of the Mn content is specified to 0.05%.

The P content is specified to a range of from 0.003 to 0.1%.

Phosphorus is an element for strengthening solid solution. Thus, the increased added amount of P degrades the ductility. Accordingly, the P content is specified to 0.1% or less. Less P content further improves the ductility. Considering the balance between the P-removal cost during the steel making process and the workability, the lower limit of P content is specified to 0.003%. To attain better workability, 0.015% of P content is preferred. In that case, however, the grain growth becomes active, which makes the grain size reduction in the hot-rolled sheet difficult, thus the coiling temperature is preferred to be set to a lower level.

The S content is specified to a range of from 0.0003 to 0.02%.

Sulfur is an element to induce red shortness. Consequently, the upper limit of S content is generally specified responding to the added amount of Mn which has a function to fix S. If, however, the S content is high level, the precipitation of sulfide becomes significant. By taking into account of the tendency, the present invention specifies the S content to 0.02% or less. On the other hand, less S content is more preferable in view of workability. By considering the balance between the S removal cost during the steel making process and the workability, the present invention specifies the lower limit of S content to 0.0003%. If the S content is 0.012% or less, the elongation and the deep drawing performance can be brought to higher level, and the adding amount of carbide-forming elements can be reduced. Therefore, the S content is preferably to specify to 0.012% or less. In this case, however, the grain growth becomes active, and the grain size reduction in the hot-rolled sheet becomes difficult. Accordingly, the coiling temperature after the hot-rolling is preferred to be set to a lower level. Even when the S content is in a range of from 0.012 to 0.02%, however, the elongation and the deep drawing performance can be brought to higher level, and the anisotropic property can be suppressed to a low level by setting the coiling temperature to a high level.

The content of sol. Al is specified to a range of from 0.005 to 0.1%.

Aluminum has an effective action as a deoxidizing element for molten steel. Excess amount of Al, however, gives bad influence on workability. Therefore, the Al content is specified to 0.1% or less. If, however, the adding amount of Al is limited to a least amount necessary for deoxidization, steel still contains sol. Al at 0.005% or more. As a result, the lower limit of A content is specified to 0.005%.

The N content is specified to a range of from 0.0003 to 0.004%.

Less amount of N further improves the ductility and the deep drawing performance. By considering the current steel making conditions, the present invention specifies the lower limit of N content to 0.0003%. If the N content is not more than 0.004%, the ductility and the deep drawing performance can be improved as IF steel, in which no solid solution of interstitial elements exists, by fixing the nitride-forming elements (Ti, Nb, or the like). Therefore, the N content is specified to 0.004% or less. If the N content is not more than 0.002%, the elongation and the deep drawing performance can further be improved, and the adding amount of nitride-forming elements can be reduced. Accordingly, the N content is preferably 0.002% or less. In that case, however, the grain growth becomes active, which makes the grain size reduction in the hot-rolled sheet difficult. Consequently, the coiling temperature is preferably to set to a low level. Even when the N content is in a range of from 0.002 to 0.004%, however, the elongation and the deep drawing performance can be brought to higher level, and the anisotropic property can be suppressed to a low level by setting the coiling temperature to a high level.

The content of one or more of Ti, Nb, V, and Zr is specified to a range of from 0.005 to 0.1% as the sum of them.

Titanium, Nb, V, and Zr are the elements that improve the elongation and the deep drawing performance by forming carbide, nitride, and sulfide to fix the solid solution of C, N, and S, respectively, as precipitates thereof in the steel. When these characteristics are particularly requested, one or more of these elements are preferred to be added. If the sum of Ti, Nb, V, and Zr amount is less than 0.005%, the effect for improving the elongation and the deep drawing performance cannot be attained. If, inversely, the sum of them exceeds 0.1%, the workability degrades. Therefore, the sum of Ti, Nb, V, and Zr is specified to a range of from 0.005 to 0.1%.

The Cu content is specified to a range of from 0.015% to 0.08%.

Copper is an element that effectively functions as a sulfide-forming element, and reduces bad influence of solid solution S on the material quality. When these characteristics are particularly requested, Cu is preferred to be added. That kind of effect is attained when Cu is added to amounts of 0.005% or more. Since steel contains Cu at amounts of less than 0.01% as an impurity, the Cu content is specified to 0.015% or more. On the other hand, if the Cu content exceeds 0.08%, the steel becomes excessively hard. Therefore, the Cu content is specified to 0.08% or less.

The B content is specified to a range of from 0.0001 to 0.001%.

Boron is an element that improves longitudinal crack resistance of steel. When the function is particularly requested, B is preferred to be added. If the B content is less than 0.0001%, the effect of longitudinal crack resistance cannot be attained. The B content over 0.001% saturates the effect. Therefore, the B content, if it is added, is specified to a range of from 0.0001 to 0.001%.

2. Process conditions

According to the Best mode 2, a slab having the composition given above is heated, hot-rolled, cold-rolled, and annealed to manufacture a cold-rolled steel sheet. The hot-rolling comprises the steps of: applying the finish-rolling with the total reduction in thickness of two passes before the final pass in a range of from 25 to 45%, with the reduction in thickness at the final pass in a range of from 5 to 25%, and with the finish temperature in a range of from the $Ar_3$ transformation point to the ($Ar_3$ transformation point+50° C.), to the end of the finish-rolling; applying cooling by a rapid cooling with a starting cooling speed in a range of from 200 to 2,000° C./sec within 1 second after completing the finish-rolling, the temperature reduction from the finish temperature of the finish-rolling in the rapid cooling being in a range of from 50 to 250° C., and the temperature to stop the rapid cooling being in a range of from 650 to 850° C.; applying slow cooling or air cooling to the steel strip at a rate of 100° C./sec or less; and applying coiling to thus obtained hot-rolled steel strip. These conditions are described in detail in the following.

(1) The total reduction in thickness of two passes before the final pass of the finish-rolling is specified to a range of from 25 to 45%. The reduction in thickness of the final pass of the finish-rolling is specified to a range of from 5 to 25%.

The reason of the above-described specification is to accumulate strain at a sufficient quantity to reduce grain size in the hot-rolled steel sheet while assuring the shape property and the transferability thereof during the manufacturing process. The reduction in thickness in the two passes before final pass is herein defined as:

$$[(L2-L1)/L2]\times 100$$

where, L2 is the thickness of the steel strip before entering the pass before the last pass before the final pass of the finish-rolling unit, and L1 is the thickness of the steel strip after the pass before the final pass.

For reducing the grain size in the hot-rolled steel sheet, it is preferable to accumulate strain at a very close portion to the transformation point by hot-working. During the hot-rolling, however, the sheet temperature reduces along the passage from inlet to outlet, and the steel strip is gradually hardened to increase the working resistance. Therefore, large reduction in thickness in the final pass has a limit. That is, large reduction in thickness in the final pass induces irregular shape of steel sheet and problems on transferability of the steel strip. Accordingly, to accumulate work strain to attain fine grains while assuring shape property and transferability of the steel sheet, it is necessary to apply above-specified reduction in thickness in two passes before the final pass of the final-rolling, thus introducing adequate quantity of strain at adequate timing.

The specification of total reduction in thickness in the two passes before the final pass of the finish-rolling to 45% or less is to secure the transferability and the shape of the steel sheet. The reason of the specification of the total reduction in thickness to not less than 25% is that below 25% of total reduction in thickness gives insufficient quantity of strain during the hot-working, and the reduction in grain size in the hot-rolled sheet becomes difficult to attain. Also the reduction in thickness of the final pass is specified to 5% or more to fully accumulate the strain during the hot-working, and to 25% or less to assure the transferability and the shape of the steel sheet. If the above-described conditions for hot-rolling are satisfied, the reduction in thickness in the rough-rolling step of the hot-rolling and the passes before the pass before two passes before the final pass of the finish-rolling raise no problem, and they may be conventionally applied ranges.

For further improving the material characteristics such as elongation and deep drawing performance of cold-rolled steel sheet, it is preferred to specify the total reduction in thickness of the two passes before the final pass of the finish-rolling to a range of from 35 to 45% and/or to specify the reduction in thickness of the final pass to a range of from 8 to 25%. Under the condition, the work strain during hot-rolling can be further accumulated to attain advantageously the fine grains. In view of the transferability and the shape of hot-rolled steel strip, it is preferred to regulate the total reduction in thickness of the three passes at exit side including the final pass to 50% or less.

The thickness of the sheet bar before the finish-rolling is preferably 20 mm or more. Regulating the thickness of the sheet bar to the range allows the absolute value of drafting to increase and makes the preparation of material quality in rolling step easy. Nevertheless, regulating the thickness of the sheet bar to that size is not an essential condition. For example, even with a hot-rolling unit in which a continuous casting machine for thin slabs and a hot-rolling mill are directly connected to each other, a material having superior quality (quality after the cold-rolled and annealed) manufactured by prior art can be attained under a condition that the process is controlled to satisfy the following-described conditions if only the specified passes in the finish-rolling satisfy the above-given conditions.

(2) Finish temperature is specified to a range of from the $Ar_3$ transformation point to the ($Ar_3$ transformation point+50° C.).

The reason to specify the finish temperature as given above is to complete the finish-rolling in $\gamma$ region and to sufficiently reduce the grain size in the hot-rolled sheet utilizing the accumulated work strain in the $\gamma$ region and utilizing the fine $\gamma$ grains. If the finish temperature is below the $Ar_3$ transformation point, the rolling is carried out by the $\alpha$ region rolling, which induces coarse grain generation. If the finish temperature exceeds the ($Ar_3$ transformation point+50° C.), $\gamma$ grain growth begins after the completion of rolling, which is unfavorable to size reduction in hot-rolled sheet. Therefore, the finish temperature is specified to ($Ar_3$ transformation point+50° C.) or less.

(3) Cooling speed is specified to a range of from 200 to 2,000° C./sec.

The reason to specify the cooling speed after completed the finish-rolling as 200° C./sec or more is to attain fine grains in the hot-rolled sheet and to improve the mechanical properties of thus obtained cold-rolled steel sheet. The present invention aims mainly to establish a cooling method to conduct cooling while breaking the vapor film formed on the surface of steel sheet during the cooling step, (cooling in nuclear boiling mode), as a main means, not a cooling method to conduct cooling while generating steam, observed in a laminar cooling method, (cooling in film boiling mode). In the nuclear boiling mode cooling, the cooling speed naturally becomes to 200° C./sec or more. Based on approximate theoretical limit in the nuclear boiling mode cooling, the upper limit of the cooling speed is specified to 2,000° C./sec. Any type of apparatus to conduct that level of cooling speed may be applied if only the apparatus conducts the nuclear boiling mode cooling. Examples of the applicable apparatuses are perforated ejection type, and very close position nozzle+high pressure+large volume of water type.

Since the cooling speed differs with the sheet thickness, further precisely specifying the cooling speed may be done by specifying, for example, "cooling a steel sheet having thicknesses of from 2.5 to 3.5 mm at cooling speeds of from 200 to 2,000° C./sec". The present invention, however, requires to have that range of cooling speed independent of the thickness of steel sheet. To do this, it is preferable to apply an apparatus which has a cooling capacity to give that range of cooling speed independent of sheet thickness if only the sheet is an ordinary hot-rolled steel sheet. Further preferred range of the cooling speed is from 400 to 2,000° C./sec. Cooling in this range further improves the elongation and the deep drawing performance of cold-rolled and annealed sheet, and anisotropic property can be suppressed to further low level.

In the Best mode 2, the cooling speed after the finish-rolling is defined as [200/Δt], using the time (Δt) necessary to cool the sheet from 900° C. to 700° C., by a 200° C. range. According to the present invention, the rapid cooling begins "in a range of from $Ar_3$ transformation point to ($Ar_3$ transformation point+50° C.) and within one second from the completion of the finish-rolling". Depending on the steel composition of slab, actual beginning of cooling may be at less than 900° C. Even in such a case, the cooling speed conforms to the definition. That is, the cooling speed is determined from the cooling of the target steel strip from, hypothetically, 900° C. to 700° C. Actual temperature to start cooling may be 900° C. or below, and the temperature to stop the rapid cooling may also be 700° C. or below.

(4) Time to start cooling is specified to within 1 second from the completion of finish-rolling.

The specification of the time to start cooling is settled to fully reduce the grain size of hot-rolled steel sheet by increasing the cooling speed to above-described level and by shortening the time to start cooling after completing the finish-rolling. Through the action, the elongation and the deep drawing performance are improved, and the anisotropic property can be reduced. If the time to start cooling exceeds 1 second, the resulted grain size in hot-rolled steel sheet is almost the same with that of ordinary laminar cooling and of laboratory air cooled experiments, and full reduction of the grain size in hot-rolled steel sheet cannot be attained.

The Best mode 2 does not specifically specify the lower limit of the time to start cooling. However, even when the rolling speed is increased and when the cooling is started at a very close position to the exit of finish-rolling, the lower limit of the time to start cooling becomes substantially 0.01 second if the housing of the cooling unit and the protrusion of the rolling mill roll by the radius length thereof are taken into account.

Even if the time to start cooling is within 1 second, the resulting characteristics differ in respective times. Within 0.5 second of the time to start cooling provides improvement of deep drawing performance and less-anisotropic property by priority. Within a range of from 0.5 to 1 second of the time to start cooling provides elongation improvement by priority. The reason of the difference of characteristics should come from the slight difference in ferritic grain size at the step of cold-rolling and annealing, though the detail of the mechanism is not fully analyzed.

For example, when the rolling speed (travel speed of hot-rolled steel strip during rolling) is not more than 1,300 m/min, to attain within 1 second of the time to start cooling, the cooling unit (for example, a cooling unit which conducts the nuclear boiling cooling described before) is installed at a place in a range of from directly next to the exit of the final pass of the finish-rolling unit to 15 meters therefrom, depending on the rolling speed. That is, when the rolling speed is high, the cooling unit may be installed downstream side to the above-specified range. When the rolling speed is slow, the cooling unit may be installed upstream side to the above-specified range to realize the time to start cooling within 1 second. If a high speed rolling which applies rolling speeds above 1,300 m/min is available, the place for installing the cooling unit is expected to further distant place than the exit of the final pass.

Even when the cooling can be started within 1 second, if the time to start cooling dispersed in the longitudinal direction of the steel strip, the grain sizes become dispersed in a hot-rolled coil, which hinders the effective improvement of material quality in the cold-rolled and annealed sheet. Actually, the hot-rolling is not always conducted under a steady speed. That is, the rolling is carried out at a slow speed until the front end of the steel strip winds around the coiler. After that, the rolling speed is gradually increased to a specified level after the steel strip winds around the coiler and after a tension is applied to the steel strip. Then, the rolling is conducted in that state to the rear end of the coil. Accordingly, if the cooling unit that conducts the rapid cooling is treated as a single control target unit, the time to start cooling differs in the coil longitudinal direction, thus, for the case of grain size reduction, the dispersion in the grain size reduction, and further the dispersion in the material quality after the cooling and annealing are induced.

To avoid the dispersion in the grain size reduction, and further the dispersion in the material quality, the cooling unit may be divided into smaller sub-units, and an ON/OFF control may be applied to individual sub-units while they are linked with the rolling speed. In that case, at the coil front end portion where a slow rolling speed is applied, the cooling is carried out using the sub-unit of the final pass side, after that, the sub-unit of cooling is shifted toward the sub-unit at the coiler side responding to the gradually increasing rolling speed, thus uniformizing the time to start cooling in the coil longitudinal direction to reduce the grain size and to homogenize the material quality.

(5) Temperature reduction during rapid cooling is specified to a range of from 50 to 250° C.

The reason to specify the temperature reduction during rapid cooling to a range of from 50 to 250° C. is to optimize the grain size reduction in the hot-rolled sheet to improve the elongation and the deep drawing performance of the cold-rolled and annealed sheet and to suppress the anisotropic property to a low level. As described before, when the two conditions of "regulating the cooling speed to a range of from 200 to 2,000° C./sec" and "limiting the time to start cooling to 1 second or less" are satisfied, the temperature reduction in the final pass is slight, and the temperature to start cooling and the finish temperature can be treated as the same value, so that the "temperature reduction from the finish temperature" is specified as above-described.

To conduct optimum grain size reduction in hot-rolled steel sheet, it is not satisfactory solely to give rapid cooling through a specified temperature range, as described above, and it is particularly necessary to limit the temperature reduction by rapid cooling into an adequate range. If the temperature reduction by the rapid cooling comes outside of an adequate range, formation of polygonal and ferritic grains cannot be attained, resulting in grains extended in the rolling direction and grains having a quenched structure, which fails in obtaining superior workability and less-anisotropic property. In this regard, the present invention specifies the temperature reduction in the rapid cooling as described above.

The reason to specify the temperature reduction by the rapid cooling to 50° C. or more is that, to conduct cooling at the above-describe cooling speed across the $\gamma$–$\alpha$ transformation point, a temperature reduction of 50° C. at the minimum is required. The reason to specify the temperature reduction to 250° C. or less is that a temperature reduction of higher than 250° C. results in significant bad influence caused from excessive cooling. In particular, when the elongation of the cold-rolled and annealed steel sheet is to be improved, the temperature reduction is preferably to select to 150° C. or less.

To control the temperature reduction by the rapid cooling to the above-described range, it is effective that the above-described cooling unit which conducts the cooling in nuclear boiling mode is divided into small sub-units in the rolling direction and that the cooling in each of the sub-units is subjected to ON/OFF control linking with the rolling speed. The temperature reduction by the rapid cooling is determined by the cooling speed of the cooling unit for rapid cooling, the length of the section to conduct rapid cooling in the cooling unit, and the rolling speed (travel speed of the steel strip). Therefore, it is difficult to maintain the temperature reduction by the rapid cooling in the above-described range, and also difficult to keep the temperature reduction to a certain level over the whole length of the coil in the longitudinal direction thereof unless the control is performed as described above, thus resulting in dispersed characteristics of the cold-rolled and annealed steel sheet.

In concrete terms, the cooling speed of the rapid cooling in nuclear boiling mode varies with the sheet thickness, or being slowed for thicker sheet and being quickened in thinner sheet. And, the cooling speed is not uniform over the whole length of a coil in most cases. Thus, it is often to reduce the rolling speed until the steel strip winds around the coiler, then to increase the speed to a certain level under tension applied to the steel strip. Consequently, the temperature reduction by the rapid cooling can be adequately controlled by dividing the cooling unit into small sub-units and by determining the number and the positions of the sub-units for the cooling responding to the rolling speed which varies as described above, thus by conducting ON/OFF control on each of the sub-units.

It is further important to promptly remove the water used in the rapid cooling. For example, if the water flows out on and after the exit of the cooling unit, the cooling of steel sheet sustains corresponding to the residual amount of the water. If the water is left on the steel sheet at an excess amount at the exit of the cooling unit, the cooling mode at the area becomes either a mixed mode of nuclear boiling and film boiling or a mode of transition to film boiling mode, depending on the water pressure against the steel sheet and the rolling speed. In any mode, the cooling sustains at a higher cooling speed than that of sole film boiling mode. The phenomenon directly induces dispersion of the effect to improve the characteristics of steel sheet obtained from the rapid cooling. In the case of excessive cooling, no polygonal ferritic grains can be formed. These disadvantages lead to degradation of material quality. To prevent the bad influence, a draining device, a draining roll, an air curtain, or the like may be located at the exit of the cooling unit.

(6) Temperature to stop the rapid cooling is specified to a range of from 650 to 850° C.

The reason to specify the temperature to stop the rapid cooling as above is to adequately conduct the reduction in grain size of the hot-rolled steel sheet, along with the above-described conditions of "cooling speed", "time to start cooling", and "temperature reduction of the rapid cooling". If the temperature to stop cooling exceeds 850° C., the grain growth after the stop cooling cannot be neglected in some cases, which is not preferable in view of reduction of grain size in the hot-rolled steel sheet. If the temperature to stop cooling becomes less than 650° C., a quenched structure may appear even when the above-described conditions of "cooling speed", "time to start cooling", and "temperature reduction of the rapid cooling" are satisfied. In that case, the characteristics of cold-rolled and annealed steel sheet cannot be improved. The temperature to stop the rapid cooling is the temperature of steel sheet at the exit of the rapid cooling unit: defined by [(Finish temperature)–(Temperature reduction by the rapid cooling)]. The temperature to stop the rapid cooling is required to be set, naturally, to the coiling temperature or above. Although the temperature to stop the rapid cooling is the temperature of steel sheet at the exit of the rapid cooling unit. In the case that, for example, the cooling unit comprises multi-bank configuration, the temperature of the steel strip at the point that the steel strip passes through a bank which is used for cooling may be controlled to the above-specified range. To control the temperature to stop cooling to the above-given range, a draining device, a draining roll, an air curtain, or the like may be located at the exit of the cooling unit to control the temperature to stop cooling.

(7) Cooling after the rapid cooling is specified to be carried out by slow cooling or air cooling at speeds of 100° C./sec or less.

After the rapid cooling on a hot-rolling runout table, as described before, the slow cooling or the air cooling is applied at speeds of 100° C./sec or less down to the coiling temperature. The reason of specifying the cooling speed is to improve the characteristics of cold-rolled and annealed steel sheet by forming polygonal and fine ferritic grains as described above. Since sole rapid cooling applied to cool the steel sheet down to the coiling temperature induces bad influence and fails to obtain wanted structure, slow cooling or air cooling at speeds of 100° C./sec or less is an essential step. If the cooling speed exceeds 100° C./sec, formation of polygonal ferritic grains becomes difficult.

(8) Coiling temperature

The coiling temperature is not specifically limited. However, it is preferred to regulate the coiling temperature to a range of from 550 to 750° C. If the coiling temperature is less than 550° C., the resulted steel is hardened. As described above, the rapid cooling inevitably adopts the coiling temperatures of 750° C. or below. And, even if the coiling temperature is brought to above 750° C., the characteristics cannot be improved.

If the steel contains large quantity of C, S, and N, (or 0.002 to 0.004% C, 0.012 to 0.02% S, or 0.002 to 0.004% N), the coiling temperature is preferably selected to a range of from 630 to 750° C. By selecting the range, the formation and growth of precipitates are enhanced, thus removing the elements (fine precipitates) that hinder the growth of ferritic grains in the cold-rolled and annealed steel sheet.

If the steel contains small quantity of C, S, P, and N, (or 0.0003 to 0.002% C, 0.0003 to 0.012% S, 0.003 to 0.015% P, or 0.0003 to 0.002% N), the coiling temperature is preferably selected to a range of from 550 to 680° C. By selecting the range, extremely active growth of grains is suppressed owing to least quantity of these elements, thus effectively performing the reduction in grain size in the hot-rolled steel sheet.

(9) Cold-rolling

The condition of cold-rolling is not specifically limited. However, the reduction in thickness in cold-rolling (cold reduction in thickness) is preferably selected to a range of from 50 to 90%. By selecting the range, the improvement effect of characteristics is attained in the hot-rolled sheet prepared by the above-described procedure giving reduced grain size.

(10) Annealing

The condition of annealing is not specifically limited. However, in view of improvement in characteristics and of prevention of rough surface, the annealing is preferably conducted at temperatures of from 700 to 850° C. Any type of annealing method can be applied such as continuous annealing and batchwise annealing.

According to the present invention, favorable material can be obtained by applying the above-described process conditions to a steel having the above-described compositions, with any type of method: the method of hot-rolling a continuously cast slab without heating in a heating furnace;

the method of hot-rolling in which a continuously cast slab is preliminarily heated to a specified temperature in a heating furnace before the slab is cooled to room temperature; the method of hot-rolling in which the slab is preliminarily heated to a specified temperature in a heating furnace after the slab is cooled to room temperature; the method of hot-rolling in which a slab is rolled in a connected facility of a thin slab continuous casting unit and a hot-rolling mill; and the method of hot-rolling in which an slab prepared from ingot is trimmed and then heated in a heating furnace.

The cold-rolled steel sheets according to the Best mode 2 can be preferably applied to the uses particularly requiring workability, which uses include the steel sheets for automobiles, steel sheets for electric equipment, steel sheets for cans, and steel sheets for buildings. The cold-rolled steel sheets according to the Best mode 2 function their characteristics fully also in other uses. The cold-rolled steel sheets according to the Best mode 2 includes those of surface-treated, such as Zn plating and alloyed Zn plating.

EXAMPLE 1

Each of the steels having the compositions of Table 4 was formed in a slab having individual thicknesses of from 200 to 300 mm. The slab was hot-rolled under the respective hot-rolling conditions including the cooling conditions given in Table 5, to form a hot-rolled steel sheet having a thickness of 2.8 mm. The hot-rolled steel sheet was cold-rolled to a thickness of 0.8 mm. Then the steel sheet was heated at respective speeds of from 6 to 20° C./sec, followed by continuously annealing at respective annealing temperatures given in Table 5 for 90 seconds to obtain each of the cold-rolled steel sheets Nos. 1 through 18. The steel sheets indicated by "conventional laminar cooling" in Table 5 were those subjected to laminar cooling which applies cooling to the hot-rolled steel strip after passing the final pass of the finish rolling while generating steam. For the steel sheets which were subjected to rapid cooling at speeds of 200° C./sec or more after the finish rolling, the cooling in nuclear boiling mode generated steam on cooling to hinder the rapid cooling because the steam film enclosed the steel sheet. Consequently, a cooling of nuclear boiling mode that does not generate steam on cooling was established using a perforated ejection type cooling unit to conduct the rapid cooling giving various cooling speeds shown in Table 5 by varying the quantity and pressure of water.

With thus prepared steel sheets, total elongation was determined on the cold-rolled steel sheets having a thickness of 0.8 mm, and r0, r45, and r90 were determined, (r0 is the r value in the L direction (0° to the rolling direction), where r45 is the r value in the D direction (45° to the rolling direction), and r90 is the C direction (90° to the rolling direction). Table 5 shows the total elongation and the average r value as the indexes to evaluate the workability of the steel sheets. And, as an index to evaluate the anisotropic property, for the steel sheet that provides r45 as the minimum value among r0, r45, and r90, the value of Δr was applied, and for the steel sheet that provides r45 as intermediate value between r0 and r90, the value of (maximum value−minimum value) of the r value was applied. The average r value referred herein is defined by:

$$\text{Average } r \text{ value}=(r0+2\times r45\times r90)/4$$

The Δr is defined by:

$$\Delta r=(r0+r90-2\times r45)/2$$

Table 5 also shows the evaluation result on the shape property and transferability of the steel sheets by two judgment results: good and bad. Problems are induced on the shape property and the transferability of steel sheets when center buckle was generated to extend the center portion of the steel strip in width direction thereof to result in irregularity in the shape, or when the shape of coil is displaced on winding around the coiler. The phenomenon resembles that observed in an adhesive tape coil. That is, the shape of new adhesive tape coil corresponds to the steel strip coil in favorable state. And, the shape of adhesive tape coil after long time of use giving displacement between external periphery and internal periphery, or the shape of adhesive tape wound again after once-rewound giving irregular shape. In Example 1, the case that the center buckle was visually observed or that the irregularity on coil side exceeded 25 mm was evaluated as "bad", and the case that no center buckle was confirmed and that the coil side irregularity was not more than 25 mm was evaluated as "good".

TABLE 4

| | C | Si | Mn | P | S | sol. Al | N | Cu | B | Ti | Nb | V | Zr | Remark |
|---|---|---|---|---|---|---|---|---|---|---|---|---|---|---|
| A | 0.0018 | 0.01 | 0.15 | 0.008 | 0.0115 | 0.035 | 0.0019 | 0.018 | — | 0.031 | 0.015 | — | — | Example steel |
| B | 0.0006 | 0.01 | 0.17 | 0.004 | 0.0034 | 0.044 | 0.0009 | 0.010 | 0.0004 | — | — | — | — | Example steel |
| C | 0.0009 | 0.01 | 0.11 | 0.003 | 0.0021 | 0.040 | 0.0010 | 0.010 | 0.0003 | 0.030 | — | — | — | Example steel |
| D | 0.0035 | 0.01 | 0.17 | 0.012 | 0.0175 | 0.045 | 0.0018 | 0.020 | — | 0.085 | — | 0.005 | 0.002 | Example steel |
| E | 0.0020 | 0.01 | 0.17 | 0.011 | 0.0110 | 0.045 | 0.0034 | 0.010 | — | 0.071 | — | — | — | Example steel |
| F | 0.0018 | 0.01 | 0.15 | 0.008 | 0.0115 | 0.035 | 0.0019 | 0.080 | 0.0002 | 0.045 | — | — | — | Example steel |
| G | 0.0020 | 0.01 | 0.65 | 0.050 | 0.0092 | 0.045 | 0.0025 | 0.010 | — | 0.020 | 0.02 | — | — | Example steel |
| H | 0.0021 | 0.01 | 1.00 | 0.075 | 0.0070 | 0.045 | 0.0024 | 0.013 | 0.0006 | 0.045 | — | — | — | Example steel |
| I | 0.0025 | 0.01 | 2.10 | 0.075 | 0.0085 | 0.045 | 0.0028 | 0.013 | 0.0011 | 0.045 | — | — | — | Example steel |

TABLE 5

| No. | Material | Total reduction in thickness of two passes before the final pass (%) | Reduction in thickness at the final pass (%) | Finish temp (° C.) | Cooling by rapid cooling: Cooling speed (° C./sec) | Cooling by rapid cooling: Time for beginning the cooling (sec) | Cooling by rapid cooling: Temp reduction (° C.) | Cooling by rapid cooling: Temp to stop the rapid cooling (° C.) | Cooling speed after the rapid cooling (° C./sec) | Coiling temp (° C.) | Annealing temp (° C.) | Total elongation (%) | Average r value | Δr | Difference between the max value and the min. value of r | Shape and transferability of steel sheet | Remark |
|---|---|---|---|---|---|---|---|---|---|---|---|---|---|---|---|---|---|
| 1 | A | 44 | 11 | 910 | 40 | | (Conventional laminar cooling) | | | 640 | 850 | 56.8 | 1.78 | 0.77 | — | Good | C |
| 2 | A | 44 | 11 | 910 | 220 | 0.3 | 130 | 780 | 40 | 640 | 850 | 58.5 | 2.26 | 0.52 | — | Good | E |
| 3 | B | 38 | 10 | 910 | 40 | | (Conventional laminar cooling) | | | 640 | 850 | 55.1 | 1.70 | 0.79 | — | Good | C |
| 4 | B | 38 | 12 | 910 | 210 | 0.3 | 130 | 780 | 45 | 640 | 850 | 57.5 | 1.88 | 0.67 | — | Good | E |
| 5 | C | 41 | 12 | 905 | 40 | | (Conventional laminar cooling) | | | 590 | 830 | 58.5 | 1.95 | 0.77 | — | Good | C |
| 6 | C | 42 | 10 | 905 | 410 | 0.2 | 200 | 705 | 40 | 590 | 830 | 59.8 | 2.30 | 0.51 | — | Good | E |
| 7 | D | 36 | 15 | 910 | 40 | | (Conventional laminar cooling) | | | 680 | 850 | 58.1 | 1.96 | 0.69 | — | Good | C |
| 8 | D | 36 | 15 | 910 | 220 | 0.3 | 130 | 780 | 45 | 680 | 850 | 59.0 | 2.29 | 049 | — | Good | E |
| 9 | E | 45 | 8 | 920 | 40 | | (Conventional laminar cooling) | | | 640 | 850 | 57.8 | 1.90 | 0.75 | — | Good | C |
| 10 | E | 45 | 8 | 920 | 450 | 0.4 | 130 | 790 | 42 | 640 | 850 | 59.1 | 2.23 | 0.51 | — | Good | E |
| 11 | F | 39 | 14 | 915 | 40 | | (Conventional laminar cooling) | | | 640 | 850 | 58.0 | 1.87 | 0.76 | — | Good | C |
| 12 | F | 40 | 16 | 915 | 250 | 0.3 | 130 | 785 | 43 | 640 | 850 | 59.5 | 2.31 | 0.49 | — | Good | E |
| 13 | G | 33 | 12 | 910 | 40 | | (Conventional laminar cooling) | | | 640 | 810 | 43.0 | 1.81 | — | 0.59 | Good | C |
| 14 | G | 34 | 12 | 910 | 220 | 0.3 | 130 | 780 | 45 | 640 | 810 | 44.8 | 2.01 | — | 0.42 | Good | E |
| 15 | H | 45 | 10 | 910 | 40 | | (Conventional laminar cooling) | | | 640 | 800 | 39.9 | 1.74 | — | 0.57 | Good | C |
| 16 | H | 45 | 10 | 910 | 250 | 0.3 | 130 | 780 | 45 | 640 | 800 | 41.6 | 1.95 | — | 0.48 | Good | E |
| 17 | I | 30 | 9 | 910 | 40 | | (Conventional laminar cooling) | | | 640 | 785 | 35.7 | 1.45 | — | 0.58 | Good | C |
| 18 | I | 31 | 8 | 910 | 500 | 0.3 | 150 | 760 | 40 | 640 | 785 | 36.3 | 1.66 | — | 0.49 | Good | E |

Figures with underline are out of the scope of the present invention.
C: Comparative example
E: Example As seen in Table 5, the steel sheets Nos. 2, 4, 6, 8, 10, 12, 14, 16, and 18 which were manufactured by rapid cooling under the process conditions of Best mode 2 gave good shape property and transferability, giving extremely high elongation and average r value, while suppressing the value of Δr or (maximum r value−minimum r value) to an extremely low level. Thus, these steels provided extremely superior workability and less-anisotropic property. To the contrary, the steel sheets Nos. 1, 3, 5, 7, 9, 11, 13, 15, and 17 which were subjected to laminar cooling from both upper side and lower side of the steel sheets on the runout table after the final pass showed inferiority in either one of above-given characteristics.

As described above, it was confirmed that, if the steels having the compositions within the range specified by the Best mode 2, and if the cold-rolled steel sheets are manufactured under the process conditions specified by the Best mode 2, the cold-rolled steel sheets giving superior shape property and transferability having far superior workability and less-anisotropic property to conventional ones can be manufactured.

EXAMPLE 2

The steels having the compositions given in Table 6 were continuously cast to form slabs having 250 mm in thickness. After trimming, the slab was heated to 1,200° C., hot-rolled and cold-rolled under respective conditions given in Table 7, then continuously annealed at respective temperature increase speeds of from 10 to 20° C./sec and at annealing temperature of 840° C. for 90 seconds, thus obtained cold-rolled steel sheets Nos. 19 through 44. As for the steel sheet No. 30, the thickness of hot-rolled steel sheet was 1.5 mm, and the thickness of cold-rolled and annealed steel sheet was 0.75 mm. For other steel sheets Nos. 19 through 29 and 31 through 44, the thickness of hot-rolled steel sheet was 28±0.2 mm, and the thickness of cold-rolled and annealed steel sheet was 0.8 mm. The cooling speed of the steel sheet No. 30 in Table 4 was the value for the 1.5 mm in thickness of hot-rolled steel sheet, and the confirmation of the cooling speed on the steel sheets having thicknesses of from 2.8 to 3.5 mm gave the cooling speed of 70±70° C./sec. Thus obtained characteristics of cold-rolled steel sheets were evaluated in the same procedure with Example 1. The result is given in Table 7. The total elongation of the steel sheet No. 30 was the value converting the value observed on a cold-rolled steel sheet having 0.75 mm in thickness into the elongation of 0.8 mm thickness sheet using the Oliver's rule.

TABLE 6

| C | Si | Mn | P | S | sol. Al | N | Cu | B | Ti | Nb | V | Zr |
|---|---|---|---|---|---|---|---|---|---|---|---|---|
| 0.0015 | tr | 0.12 | 0.006 | 0.0085 | 0.030 | 0.0015 | 0.016 | — | 0.03 | 0.01 | — | — |
| \| | \| | \| | \| | \| | \| | \| | \| | | \| | \| | | |
| 0.0020 | 0.01 | 0.17 | 0.009 | 0.012 | 0.04 | 0.0025 | 0.030 | | 0.04 | 0.02 | | |

TABLE 7

| No. | Total reduction in thickness of two passes before the final pass (%) | Reduction in thickness at the final pass (%) | Finish temperature (° C.) | Cooling by rapid cooling: Cooling speed (° C./sec) | Cooling by rapid cooling: Time for beginning the cooling (sec) | Cooling by rapid cooling: Temperature reduction (° C.) | Cooling by rapid cooling: Temperature to stop the rapid cooling (° C.) | Cooling speed after the rapid cooling (° C./sec) | Coiling temperature (° C.) | Total elongation (%) | Average r value | Δr | Shape and transferability of steel sheet | Remark |
|---|---|---|---|---|---|---|---|---|---|---|---|---|---|---|
| 19 | 55 | 10 | 910 | 200 | 0.4 | 140 | 770 | 45 | 650 | 57.9 | 2.35 | 0.53 | Bad | C |
| 20 | 41 | 14 | 905 | 250 | 0.3 | 150 | 755 | 50 | 640 | 57.8 | 2.24 | 0.54 | Good | E |
| 21 | 40 | 27 | 900 | 220 | 0.3 | 150 | 750 | 45 | 640 | 57.8 | 2.41 | 0.50 | Bad | C |
| 22 | 38 | 11 | 830 | 210 | 0.3 | 130 | 700 | 40 | 640 | 48.2 | 1.50 | 0.82 | Good | C |
| 23 | 37 | 12 | 980 | 210 | 0.3 | 130 | 850 | 42 | 640 | 53.2 | 1.63 | 0.81 | Good | C |
| 24 | 40 | 12 | 905 | 180 | 0.3 | 130 | 775 | 38 | 640 | 57.3 | 1.92 | 0.75 | Good | C |
| 25 | 35 | 13 | 910 | 400 | 0.3 | 130 | 780 | 42 | 640 | 58.5 | 2.30 | 0.50 | Good | E |
| 26 | 38 | 13 | 910 | 600 | 0.3 | 130 | 780 | 40 | 640 | 59.0 | 2.41 | 0.48 | Good | E |
| 27 | 39 | 11 | 910 | 900 | 0.3 | 130 | 780 | 41 | 640 | 58.5 | 2.48 | 0.46 | Good | E |
| 28 | 40 | 12 | 910 | 1200 | 0.3 | 130 | 780 | 41 | 640 | 57.9 | 2.39 | 0.47 | Good | E |
| 29 | 40 | 13 | 915 | 1900 | 0.3 | 250 | 665 | 40 | 640 | 57.6 | 2.37 | 0.47 | Good | E |
| 30* | 37 | 13 | 915 | 1850 | 0.3 | 250 | 665 | 42 | 640 | 57.3 | 2.32 | 0.49 | Good | E |
| 31 | 38 | 11 | 915 | 400 | 5 | 130 | 780 | 35 | 640 | 57.0 | 1.80 | 0.76 | Good | C |
| 32 | 37 | 12 | 910 | 405 | 2 | 130 | 780 | 35 | 640 | 56.9 | 1.83 | 0.74 | Good | C |
| 33 | 37 | 12 | 910 | 400 | 1 | 130 | 780 | 36 | 640 | 60.0 | 2.18 | 0.60 | Good | E |
| 34 | 37 | 12 | 910 | 400 | 0.6 | 130 | 780 | 35 | 640 | 59.6 | 2.24 | 0.52 | Good | E |
| 35 | 37 | 12 | 910 | 400 | 0.1 | 130 | 780 | 37 | 640 | 58.7 | 2.41 | 0.50 | Good | E |
| 36 | 38 | 12 | 910 | 400 | 0.02 | 130 | 780 | 35 | 640 | 58.8 | 2.55 | 0.48 | Good | E |
| 37 | 42 | 11 | 910 | 400 | 0.3 | 30 | 880 | 38 | 640 | 56.7 | 1.79 | 0.76 | Good | C |
| 38 | 41 | 12 | 910 | 450 | 0.3 | 50 | 860 | 38 | 640 | 58.4 | 2.24 | 0.54 | Good | E |
| 39 | 42 | 11 | 910 | 450 | 0.3 | 150 | 760 | 37 | 640 | 59.1 | 2.31 | 0.49 | Good | E |
| 40 | 42 | 11 | 910 | 450 | 0.3 | 240 | 670 | 37 | 640 | 57.6 | 2.43 | 0.41 | Good | E |
| 41 | 42 | 12 | 910 | 450 | 0.3 | 350 | 560 | 38 | 400 | 47.4 | 1.30 | 0.87 | Good | C |
| 42 | 35 | 20 | 890 | 450 | 0.3 | 250 | 640 | 35 | 580 | 48.3 | 1.41 | 0.83 | Good | C |
| 43 | 42 | 15 | 915 | 300 | 0.4 | 200 | 715 | 150 | 600 | 50.0 | 1.79 | 0.74 | Good | C |
| 44 | 42 | 15 | 915 | 300 | 0.4 | 200 | 715 | 90 | 600 | 55.0 | 2.21 | 0.58 | Good | E |

Figures with underline are out of the scope of the present invention.

* Thickness of hot-rolled steel sheet was 1.5 mm; thickness of cold-rolled steel sheet was 0.75 mm: elongation was converted to that of 0.8 mm sheet applying the Oliver's rule.

C: Comparative example E: Example

As shown in Table 7, the steel sheets Nos. 20, 25 through 30, 33 through 36, 38 through 40, and 44, manufactured under the process conditions of the Best mode 2 provided favorable shape property and transferability, and gave extremely high elongation and average r value, while suppressing the value of Δr to an extremely low level, and giving excellent workability and less-anisotropic property. To the contrary, the steel sheets Nos. 19, 21 through 24, 31, 32, 37, and 41 through 43 which gave either one of the conditions outside of the range of the Best mode 2 showed inferiority in either one of the above-given characteristics. In concrete terms, the steel sheets Nos. 19 and 21 showed bad shape property and transferability because the steel sheet No. 19 gave the total reduction in thickness of two passes before the final pass above the range of the Best mode 2, and because the steel sheet No. 21 gave the reduction in thickness at final pass above the range of the Best mode 2. The steel sheet No. 22 gave the finish temperature below the range of the Best mode 2 so that the α-region rolling was established, which resulted in significant degradation of total elongation. The steel sheet No. 23 gave the finish temperature above the range of the Best mode 2, thus the growth of γ-grains presumably proceeded until the rapid cooling began, which led the insufficient reduction in grain size of the hot-rolled steel sheet, thus degrading the characteristics.

The steel sheet No. 24 gave lower cooling speed than the range of the Best mode 2, so the rapid cooling was insufficient and the grain size reduction in the hot-rolled steel sheet was not attained, thus failing to obtain full improvement effect of r-value. The steel sheets Nos. 31 and 32 gave longer time to start cooling than the range of the Best mode 2, thus the grains should be fully grown. As a result, the grain size reduction in the hot-rolled steel sheet was not sufficient, and the improvement of workability and less-anisotropic property was not fully attained. The steel sheet No. 37 gave less temperature reduction in the rapid cooling than the range of the Best mode 2, so that the grain size reduction in the hot-rolled steel sheet was not sufficient, thus the improvement effect of r-value could not fully be attained. The steel sheet No. 41 gave larger temperature reduction in rapid cooling than the range of the Best mode 2, gave the temperature to stop rapid cooling below the range of the Best mode 2, and gave the coiling temperature lower than the preferred range of the Best mode 2, so that the microstructure of the hot-rolled steel sheet entered the quenched structure, thus significantly degrading the characteristics. The steel sheet No. 42 gave lower temperature to stop rapid cooling than the range of the Best mode 2, so the microstructure of the hot-rolled steel sheet did not become polygonal fine grains, and degraded the characteristics. The steel sheet No. 43 gave higher cooling speed after the rapid cooling than the range of the Best mode 2, so that the polygonal fine grains could not be formed at the hot-rolled steel sheet stage, and all the characteristics were inferior.

As described above, it was confirmed that only the manufacturing method that satisfies all the conditions specified by the Best mode 2 can manufacture the cold-rolled steel sheets having superior shape property and transferability, and giving far superior workability and less-anisotropic property to conventional method.

Best mode 3

Investigation conducted by the inventors of the present invention revealed that the technology which was proposed by Kino et al. and the technologies disclosed in the above-described Japanese Patent Publications cannot improve the mechanical properties (r value and elongation) unless the temperature reduction during rapid cooling and the temperature to stop cooling are controlled in a favorable range. That is, experiments which were carried out by the inventors of the present invention based on these technologies told that, if the temperature reduction during rapid cooling or the temperature to stop cooling is outside of respective favorable ranges, the elongation cannot be improved even when the average r value is high, and inversely the elongation may degrade, further the average r value may also degrade. In other words, excessive cooling by the rapid cooling gives bad influence on the mechanical properties, and the improvement of material quality cannot be attained solely by rapid cooling to cool over a wide temperature range including a specified temperature range, (or the temperature range extended to lower temperature side). Furthermore, when the work strain is accumulated to a large quantity aiming to reduce the grain size by increasing the total reduction in thickness of the three passes at exit side of the finish rolling, a bad influence is induced on the transferability and the shape property of the steel sheet unless the reduction in thickness of the three passes is adequately divided to each of these three passes.

To this point, the inventors of the present invention carried out study to solve the problems, and found that, in a composition on the basis of very low carbon steel, the control of hot-rolling drafting conditions and further the control of conditions for cooling the hot-rolled steel on the runout table provide a cold-rolled steel sheet having further significantly excellent workability and less-anisotropic property than ever while preventing occurrence of problems of shape property and transferability. That is, adding to the adjustment of the steel composition to a specific composition of very low carbon steel group, the following-described findings were derived.

(1) Regarding the drafting condition in the hot-rolling step, adequate setting of the reduction in thickness at the final pass of the finish-rolling and the reduction in thickness during the two passes before the final pass induce no problem of shape property of the steel sheet and of transferability of the hot-rolled steel sheet during the manufacturing process, and allow the work strain in hot-working increase within a range of inducing no problem to attain fine grain size formation.

(2) To begin the rapid cooling as promptly as possible after the completion of the finish-rolling is effective for reducing the grain size in the hot-rolled steel sheet and for improving the mechanical properties.

(3) By adequately setting the range of temperature reduction caused from the above-described rapid cooling, the excessive cooling by the rapid cooling can be suppressed, and the workability such as elongation and deep drawing performance and the less-anisotropic property can be improved.

(4) By adequately setting the temperature to stop cooling in the above-described rapid cooling, the target fine structure can be attained.

(5) By making the cooling after the rapid cooling step to a slow cooling speed, the formation of adequate polygonal ferritic grains can be realized.

The Best mode 3 has been derived based on the above-described findings, and is a method for manufacturing cold-rolled steel sheet having superior shape property and workability, and less anisotropic property as described above.

[1] A slab consisting essentially of 0.0003 to 0.004% C, 0.05% or less Si, 0.05 to 2.5% Mn, 0.003 to 0.1% P, 0.0003 to 0.02% S, 0.005 to 0.1% sol.Al, 0.0003 to 0.004% N, by weight, is heated, hot-rolled, cold-rolled, and annealed to manufacture a cold-rolled steel sheet.

The method is to manufacture a cold-rolled steel sheet providing superior shape property and workability, and less anisotropic property, wherein the hot-rolling comprises the steps of: applying the finish-rolling with the total reduction in thickness of two passes before the final pass in a range of from 45 to 70%, with the reduction in thickness at the final pass in a range of from 5 to 35%, and with the finish temperature in a range of from the $Ar_3$ transformation point to the ($Ar_3$ transformation point+50° C.), to the end of the finish-rolling; applying cooling by a rapid cooling with a starting cooling speed in a range of from 200 to 2,000° C./sec within 1 second after completing the finish rolling, the temperature reduction from the finish temperature of the finish-rolling in the rapid cooling being in a range of from 50 to 250° C., and the temperature to stop the rapid cooling being in a range of from 650 to 850° C.; applying slow cooling or air cooling to the steel strip at a rate of 100° C./sec or less; and applying coiling to thus obtained hot-rolled steel strip.

[2] In the manufacturing method [1], the slab further contains 0.005 to 0.1% by weight of at least one element selected from the group consisting of Ti, Nb, V, and Zr, as the sum thereof, to manufacture a cold-rolled steel sheet having superior shape property and workability, and having less anisotropic property.

[3] In the manufacturing method [1] or [2], the slab further contains 0.015 to 0.08% Cu, by weight, to manufacture a cold-rolled steel sheet having superior shape-formability and workability, and having less anisotropic property.

[4] In the manufacturing method [1], [2], or [3], the steel further contains 0.0001 to 0.001% B, by weight, to manufacture a cold-rolled steel sheet having superior shape property and workability, and having less anisotropic property.

In prior arts, for example, JP-A-7-70650, JP-A-6-212354, and JP-A-6-17141, there are two expressions on specifying the temperature relating to $Ar_3$ transformation point: the one is to specify the temperature itself, describing, "finish temperature: $Ar_3$ transformation temperature or above . . . ", and the other is to use the $Ar_3$ point for specifying the temperature during cooling, describing, "rapidly cool from . . . to ($Ar_3$ transformation point−50° C.)". Since the increase in rapid cooling speed lowers the $Ar_3$ transformation point, the $Ar_3$ transformation point in the latter case differs from the $Ar_3$ transformation point in the former case, and always the $Ar_3$ transformation point in the former case gives lower temperature than that in the latter case. Nevertheless, many of the prior arts give understanding that the transformation point in the latter context is the same temperature with the transformation point in the former context, which is not theoretically correct. Furthermore, since higher cooling speed decreases further the $Ar_3$ transformation point, if the latter context signifies the $Ar_3$ transformation point, the actual value of the point cannot be identified in many cases. Consequently, the present invention specifies the temperature during the rapid cooling by numerals, not using vague expression of "$Ar_3$ transformation point".

The following is detail description of the method for manufacturing cold-rolled steel sheet according to the Best mode 3 in terms of the steel composition and the process conditions.

1. Steel composition

The composition of the steel according to the Best mode 3 contains: 0.0003 to 0.004% C, 0.05% or less Si, 0.05 to 2.5% Mn, 0.003 to 0.1% P, 0.0003 to 0.02% S, 0.005 to 0.1% sol.Al, and 0.0003 to 0.004% N, by weight. The steel may further contain, at need, 0.005 to 0.1% of at least one element selected from the group consisting of Ti, Nb, V, and Zr+to improve the elongation and flange properties. The steel having either of above-specified compositions may further contain, at need, 0.015 to 0.08% Cu to reduce bad influence of the solid solution S. The steel having either one of above-specified compositions may further contain, at need, 0.0001 to0.001% B to improve the longitudinal crack resistance of the steel.

The C content is specified to a range of from 0.0003 to 0.004%.

Less C content further improves the ductility and deep drawing performance. Nevertheless, the lower limit of C content is specified to 0.0003% taking into account of the current steel making conditions. If the C content is not more than 0.004%, the ductility and the deep drawing performance can be improved by fixing C using carbide-forming element (Ti, Nb, or the like) to form a steel in which no solid solution of interstitial elements exists, (or an IF steel (Interstitial-Free steel)). Therefore, the C content is specified to not more than 0.004%. If the C content is not more than 0.002%, the elongation and the deep drawing performance can be brought to higher level, thus the adding amount of carbide-forming elements is reduced. Accordingly, the C content is preferred to limit to 0.002% or less. Even if the C content is in a range of from 0.002 to 0.004%, however, the elongation and the deep drawing performance can be brought to higher level, and the anisotropic property can be suppressed to a low level by setting the coiling temperature to a high level.

The Si content is specified to 0.05% or less.

Silicon is an element that gives bad influence on the characteristics of mildness and high ductility, and an element that gives bad influence on the surface treatment of Zn plating or the like. Silicon is also used as a deoxidizing element. If the Si content exceeds 0.05%, the bad influence on the material quality and the surface treatment becomes significant. Consequently, the Si content is specified to 0.05% or less.

The Mn content is specified to a range of from 0.05 to 2.5%.

Manganese is an element that improves the toughness of steel, and that can be effectively used for strengthening solid solution. However, excessive addition of Mn gives bad influence on the workability. In addition, Mn can be effectively used for precipitating S as MnS. The present invention specifies the Mn content to 2.5% or less emphasizing to provide high elongation and deep drawing performance, and also utilizing thereof for strengthening the steel. By taking into account of the cost for removing S during the steel making process, the lower limit of the Mn content is specified to 0.05%.

The P content is specified to a range of from 0.003 to 0.1%.

Phosphorus is an element for strengthening solid solution. Thus, the increased added amount of P degrades the ductility. Accordingly, the P content is specified to 0.1% or less. Less P content further improves the ductility. Considering the balance between the P-removal cost during the steel making process and the workability, the lower limit of P content is specified to 0.003%. To attain better workability, 0.015% of P content is preferred. In that case, however, the grain growth becomes active, which makes the grain size reduction in the hot-rolled sheet difficult, thus the coiling temperature is preferred to be set to a lower level.

The S content is specified to a range of from 0.0003 to 0.02%.

Sulfur is an element to induce red shortness. Consequently, the upper limit of S content is generally specified responding to the added amount of Mn which has a function to fix S. If, however, the S content is high level, the precipitation of sulfide becomes significant. By taking into account of the tendency, the present invention specifies the S content to 0.02% or less. On the other hand, less S content is more preferable in view of workability. By considering the balance between the S removal cost during the steel making process and the workability, the present invention specifies the lower limit of S content to 0.0003%. If the S content is 0.012% or less, the elongation and the deep drawing performance can be brought to higher level, and the adding amount of carbide-forming elements can be reduced. Therefore, the S content is preferably to specify to 0.012% or less. In this case, however, the grain growth becomes active, and the grain size reduction in the hot-rolled sheet becomes difficult. Accordingly, the coiling temperature after the hot-rolling is preferred to be set to a lower level. Even when the S content is in a range of from 0.012 to 0.02%, however, the elongation and the deep drawing performance can be brought to higher level, and the anisotropic property can be suppressed to a low level by setting the coiling temperature to a high level.

The content of sol. Al is specified to a range of from 0.005 to 0.1%.

Aluminum has an effective action as a deoxidizing element for molten steel. Excess amount of Al, however, gives bad influence on workability. Therefore, the Al content is specified to 0.1% or less. If, however, the adding amount of Al is limited to a least amount necessary for deoxidization, steel still contains sol. Al at+0.005% or more. As a result, the lower limit of A content is specified to 0.005%.

The N content is specified to a range of from 0.0003 to 0.004%.

Less amount of N further improves the ductility and the deep drawing performance. By considering the current steel making conditions, the present invention specifies the lower limit of N content to 0.0003%. If the N content is not more than 0.004%, the ductility and the deep drawing performance can be improved as IF steel, in which no solid solution of interstitial elements exists, by fixing the nitride-forming elements (Ti, Nb, or the like). Therefore, the N content is specified to 0.004% or less. If the N content is not more than 0.002%, the elongation and the deep drawing performance can further be improved, and the adding amount of nitride-forming elements can be reduced. Accordingly, the N content is preferably 0.002% or less. In that case, however, the grain growth becomes active, which makes the grain size reduction in the hot-rolled sheet difficult. Consequently, the coiling temperature is preferably to set to a low level. Even when the N content is in a range of from 0.002 to 0.004%, however, the elongation and the deep drawing performance can be brought to higher level, and the anisotropic property can be suppressed to a low level, by setting the coiling temperature to a high level.

The content of one or more of Ti, Nb, V, and Zr is specified to a range of from 0.005 to 0.1% as the sum of them.

Titanium, Nb, V, and Zr are the elements that improve the elongation and the deep drawing performance by forming carbide, nitride, and sulfide to fix the solid solution of C, N, and S, respectively, as precipitates thereof in the steel. When these characteristics are particularly requested, one or more of these elements are preferred to be added. If the sum of Ti, Nb, V, and Zr amount is less than 0.005%, the effect for improving the elongation and the deep drawing performance cannot be attained. If, inversely, the sum of them exceeds 0.1%, the workability degrades. Therefore, the sum of Ti, Nb, V, and Zr is specified to a range of from 0.005 to 0.1%.

The Cu content is specified to a range of from 0.015% to 0.08%.

Copper is an element that effectively functions as a sulfide-forming element, and reduces bad influence of solid solution S on the material quality. When these characteristics are particularly requested, Cu is preferred to be added. That kind of effect is attained when Cu is added to amounts of 0.005% or more. Since steel contains Cu at amounts of less than 0.01% as an impurity, the Cu content is specified to 0.015% or more. On the other hand, if the Cu content exceeds 0.08%, the steel becomes excessively hard. Therefore, the Cu content is specified to 0.08% or less.

The B content is specified to a range of from 0.0001 to 0.001%.

Boron is an element that improves longitudinal crack resistance of steel. When the function is particularly requested, B is preferred to be added. If the B content is less than 0.0001%, the effect of longitudinal crack resistance cannot be attained. The B content over 0.001% saturates the effect. Therefore, the B content, if it is added, is specified to a range of from 0.0001 to 0.001%.

2. Process conditions

According to the Best mode 3, a slab having the composition given above is heated, hot-rolled, cold-rolled, and annealed to manufacture a cold-rolled steel sheet. The hot-rolling comprises the steps of: applying the finish-rolling with the total reduction in thickness of two passes before the final pass in a range of from 45 to 70%, with the reduction in thickness at the final pass in a range of from 5 to 35%, and with the finish temperature in a range of from the $Ar_3$ transformation point to the ($Ar_3$ transformation point+50° C.), to the end of the finish-rolling; applying cooling by a rapid cooling with a starting cooling speed in a range of from 200 to 2,000° C./sec within 1 second after completing the finish rolling, the temperature reduction from the finish temperature of the finish-rolling in the rapid cooling being in a range of from 50 to 250° C., and the temperature to stop the rapid cooling being in a range of from 650 to 850° C.; applying slow cooling or air cooling to the steel strip at a rate of 100° C./sec or less; and applying coiling to thus obtained hot-rolled steel strip. These conditions are described in detail in the following.

(1) The total reduction in thickness of two passes before the final pass of the finish-rolling is specified to a range of from 45 to 70%. The reduction in thickness of the final pass of the finish-rolling is specified to a range of from 5 to 35%.

The reason of the above-described specification is to accumulate strain at a sufficient quantity to reduce grain size in the hot-rolled steel sheet while assuring the shape property and the transferability thereof during the manufacturing process. The reduction in thickness in the two passes before final pass is herein defined as:

$$[(L2-L1)/L2]\times 100$$

where, L2 is the thickness of the steel strip before entering the pass before the last pass before the final pass of the finish-rolling unit, and L1 is the thickness of the steel strip after the pass before the final pass.

For reducing the grain size in the hot-rolled steel sheet, it is preferable to accumulate strain at a very close portion to the transformation point by hot-working. During the hot-rolling, however, the sheet temperature reduces along the passage from inlet to outlet, and the steel strip is gradually hardened to increase the working resistance. Therefore, large reduction in thickness in the final pass has a limit. That is, large reduction in thickness in the final pass induces irregular shape of steel sheet and problems on transferability of the steel strip. Accordingly, to accumulate work strain to attain fine grains while assuring shape property and transferability of the steel sheet, it is necessary to apply above-specified reduction in thickness in two passes before the final pass of the final-rolling, thus introducing adequate quantity of strain at adequate timing. That is, the total reduction in thickness of two passes before the final pass is increased to accumulate large quantity of strain, and the strain is also accumulated in the final pass. At that moment, however, the reduction in thickness at the final pass is set to a lower level to correct the shape property and the transferability.

The specification of total reduction in thickness in the two passes before the final pass of the finish-rolling to 70% or less is to secure the transferability and the shape of the steel sheet during these passes while accumulating the work strain. The reason of the specification of the total reduction in thickness to not less than 45% is to fully conduct the strain accumulation during the hot-working step to assure mildness and high ductility and high workability of the steel sheet. Also the reduction in thickness of the final pass, higher level thereof raises no problem in view of introduction of work strain. Nevertheless, to secure the transferability and the shape property of the steel sheet to a level of no problem, the reduction in thickness is specified to 35% or less, and to 5% or more which is the level to secure minimum necessary level of transferability and shape property of the steel sheet. If the above-described conditions for hot-rolling are satisfied, the reduction in thickness in the rough-rolling step of the hot-rolling and the passes before the pass before two passes before the final pass of the finish-rolling raise no problem, and they may be conventionally applied ranges.

For further improving the material characteristics such as elongation, deep drawing performance, and less-anisotropic property of cold-rolled and annealed steel sheet, it is preferred to specify the total reduction in thickness of the two passes before the final pass of the finish-rolling to a range of from 55 to 70% to reduce the grain size of the hot-rolled steel sheet by accumulating large quantity of work strain, and/or to specify the reduction in thickness of the final pass to a range of from 15 to 35% to reduce the grain size of the hot-rolled steel sheet. In view of emphasizing the shape property of the steel sheet and the transferability of hot-rolled steel strip in the manufacturing process, it is preferred to regulate the reduction in thickness of the final pass to a range of from 5 to 15% to correct the shape and to assure the transferability, further to introduce work strain.

In the case that the reduction in thickness of the finish-rolling is large as in the case of the Best mode 3, there generally occur phenomena of abnormal shape, failing to assure transferability (transverse displacement), further of failing in correct coiling around the coiler to give external or internal protrusion, or of abnormality in the material characteristics in the width direction thereof. These phenomena are induced from the occurrence of slight temperature irregularity on the hot-rolled steel strip during hot-rolling, thus inducing difference in elongation during rolling between the center portion and the edge portion along the width of the steel strip.

According to the Best mode 3, the reduction in thickness between the final pass and the two passes before the final pass is separately specified to assure the shape property and the transferability of the hot-rolled steel strip. For further improving the shape property and the transferability, it is more preferable to heat the hot-rolled steel strip on off-line basis or on-line basis to uniformize the temperature distribution in the width direction of the steel strip. Examples of the method to uniformize the temperature distribution in the width direction of the steel strip include (1) a unit to heat a sheet bar (a hot-rolled steel strip after completed the rough-rolling) by an induction heating unit at on-line basis, (2) a unit to heat the sheet bar using a coil box after coiled, and (3) a unit that uses an induction heating unit or the like installed in the finish-rolling unit.

The thickness of the sheet bar before the finish-rolling is preferably 20 mm or more. Regulating the thickness of the sheet bar to the range allows the absolute value of drafting to increase and makes the preparation of material quality in rolling step easy. Nevertheless, regulating the thickness of the sheet bar to that size is not an essential condition. For example, even with a hot-rolling unit in which a continuous casting machine for thin slabs and a hot-rolling mill are directly connected to each other, a material having superior quality (quality after the cold-rolled and annealed) manufactured by prior art can be attained under a condition that the process is controlled to satisfy the following-described conditions if only the specified passes in the finish-rolling satisfy the above-given conditions.

(2) Finish temperature is specified to a range of from the $Ar_3$ transformation point to the ($Ar_3$ transformation point+50° C.).

The reason to specify the finish temperature as given above is to complete the finish-rolling in $\gamma$ region and to sufficiently reduce the grain size in the hot-rolled sheet utilizing the accumulated work strain in the $\gamma$ region and utilizing the fine $\gamma$ grains. If the finish temperature is below the $Ar_3$ transformation point, the rolling is carried out by the $\alpha$ region rolling, which induces coarse grain generation. If the finish temperature exceeds the ($Ar_3$ transformation point+50° C.), $\gamma$ grain growth begins after the completion of rolling, which is unfavorable to size reduction in hot-rolled sheet. Therefore, the finish temperature is specified to ($Ar_3$ transformation point+50° C.) or less.

(3) Cooling speed is specified to a range of from 200 to 2,000° C./sec.

The reason to specify the cooling speed after completed the finish-rolling as 200° C./sec or more is to attain fine grains in the hot-rolled sheet and to improve the mechanical properties of thus obtained cold-rolled steel sheet. The present invention aims mainly to establish a cooling method to conduct cooling while breaking the vapor film formed on the surface of steel sheet during the cooling step, (cooling in nuclear boiling mode), as a main means, not a cooling method to conduct cooling while generating steam, observed in a laminar cooling method, (cooling in film boiling mode). In the nuclear boiling mode cooling, the cooling speed naturally becomes to 200° C./sec or more. Based on approximate theoretical limit in the nuclear boiling mode cooling, the upper limit of the cooling speed is specified to 2,000° C./sec. Any type of apparatus to conduct that level of cooling speed may be applied if only the apparatus conducts the nuclear boiling mode cooling. Examples of the applicable apparatuses are perforated ejection type, and very close position nozzle+high pressure+large volume of water type.

Since the cooling speed differs with the sheet thickness, further precisely specifying the cooling speed may be done by specifying, for example, "cooling a steel sheet having thicknesses of from 2.5 to 3.5 mm at cooling speeds of from 200 to 2,000° C./sec". The Best mode 3, however, requires to have that range of cooling speed independent of the thickness of steel sheet. To do this, it is preferable to apply an apparatus which has a cooling capacity to give that range of cooling speed independent of sheet thickness if only the sheet is an ordinary hot-rolled steel sheet. Further preferred range of the cooling speed is from 400 to 2,000° C./sec. Cooling in this range further improves the elongation and the deep drawing performance of cold-rolled and annealed sheet, and anisotropic property can be suppressed to further low level.

In the Best mode 3, the cooling speed after the finish-rolling is defined as [200/Δt], using the time (Δt) necessary to cool the sheet from 900° C. to 700° C., by a 200° C. range. According to the present invention, the rapid cooling begins "in a range of from $Ar_3$ transformation point to ($Ar_3$ transformation point+50° C.) and within one second from the completion of the finish-rolling". Depending on the steel composition of slab, actual beginning of cooling may be at less than 900° C. Even in such a case, the cooling speed conforms to the definition. That is, the cooling speed is determined from the cooling of the target steel strip from, hypothetically, 900° C. to 700° C. Actual temperature to start cooling may be 900° C. or below, and the temperature to stop the rapid cooling may also be 700° C. or below.

(4) Time to start cooling is specified to within 1 second from the completion of finish-rolling.

The specification of the time to start cooling is settled to fully reduce the grain size of hot-rolled steel sheet by increasing the cooling speed to above-described level and by shortening the time to start cooling after completing the finish-rolling. Through the action, the elongation and the deep drawing performance are improved, and the anisotropic property can be reduced. If the time to start cooling exceeds 1 second, the resulted grain size in hot-rolled steel sheet is almost the same with that of ordinary laminar cooling and of laboratory air cooled experiments, and full reduction of the grain size in hot-rolled steel sheet cannot be attained.

The Best mode 3 does not specifically specify the lower limit of the time to start cooling. However, even when the rolling speed is increased and when the cooling is started at a very close position to the exit of finish-rolling, the lower limit of the time to start cooling becomes substantially 0.01 second if the housing of the cooling unit and the protrusion of the rolling mill roll by the radius length thereof are taken into account.

Even if the time to start cooling is within 1 second, the resulting characteristics differ in respective times. Within 0.5 second of the time to start cooling provides improvement of deep drawing performance and less-anisotropic property by priority. Within a range of from 0.5 to 1 second of the time to start cooling provides elongation improvement by priority. The reason of the difference of characteristics should come from the slight difference in ferritic grain size at the step of cold-rolling and annealing, though the detail of the mechanism is not fully analyzed.

For example, when the rolling speed (travel speed of hot-rolled steel strip during rolling) is not more than 1,300 m/min, to attain within 1 second of the time to start cooling, the cooling unit (for example, a cooling unit which conducts the nuclear boiling cooling described before) is installed at a place in a range of from directly next to the exit of the final pass of the finish-rolling unit to 15 meters therefrom, depending on the rolling speed. That is, when the rolling speed is high, the cooling unit may be installed downstream side to the above-specified range. When the rolling speed is slow, the cooling unit may be installed upstream side to the above-specified range to realize the time to start cooling within 1 second. If a high speed rolling which applies rolling speeds above 1,300 m/min is available, the place for installing the cooling unit is expected to further distant place than the exit of the final pass.

Even when the cooling can be started within 1 second, if the time to start cooling dispersed in the longitudinal direction of the steel strip, the grain sizes become dispersed in a hot-rolled coil, which hinders the effective improvement of material quality in the cold-rolled and annealed sheet. Actually, the hot-rolling is not always conducted under a steady speed. That is, the rolling is carried out at a slow speed until the front end of the steel strip winds around the coiler. After that, the rolling speed is gradually increased to a specified level after the steel strip winds around the coiler and after a tension is applied to the steel strip. Then, the rolling is conducted in that state to the rear end of the coil. Accordingly, if the cooling unit that conducts the rapid cooling is treated as a single control target unit, the time to start cooling differs in the coil longitudinal direction, thus, for the case of grain size reduction, the dispersion in the grain size reduction, and further the dispersion in the material quality after the cooling and annealing are induced.

To avoid the dispersion in the grain size reduction, and further the dispersion in the material quality, the cooling unit may be divided into smaller sub-units, and an ON/OFF control may be applied to individual sub-units while they are linked with the rolling speed. In that case, at the coil front end portion where a slow rolling speed is applied, the cooling is carried out using the sub-unit of the final pass side, after that, the sub-unit of cooling is shifted toward the sub-unit at the coiler side responding to the gradually increasing rolling speed, thus uniformizing the time to start cooling in the coil longitudinal direction to reduce the grain size and to homogenize the material quality.

(5) Temperature reduction during rapid cooling is specified to a range of from 50 to 250° C.

The reason to specify the temperature reduction during rapid cooling to a range of from 50 to 250° C. is to optimize the grain size reduction in the hot-rolled sheet to improve the elongation and the deep drawing performance of the cold-rolled and annealed sheet and to suppress the anisotropic property to a low level. As described before, when the two conditions of "regulating the cooling speed to a range of from 200 to 2,000° C./sec" and "limiting the time to start cooling to 1 second or less" are satisfied, the temperature reduction in the final pass is slight, and the temperature to start cooling and the finish temperature can be treated as the same value, so that the "temperature reduction from the finish temperature" is specified as above-described.

To conduct optimum grain size reduction in hot-rolled steel sheet, it is not satisfactory solely to give rapid cooling through a specified temperature range, as described above, and it is particularly necessary to limit the temperature reduction by rapid cooling into an adequate range. If the temperature reduction by the rapid cooling comes outside of an adequate range, formation of polygonal and ferritic grains cannot be attained, resulting in grains extended in the rolling direction and grains having a quenched structure, which fails in obtaining superior workability and less-anisotropic property. In this regard, the present invention specifies the temperature reduction in the rapid cooling as described above.

The reason to specify the temperature reduction by the rapid cooling to 50° C. or more is that, to conduct cooling at the above-describe cooling speed across the $\gamma$–$\alpha$ transformation point, a temperature reduction of 50° C. at the minimum is required. The reason to specify the temperature reduction to 250° C. or less is that a temperature reduction of higher than 250° C. results in significant bad influence caused from excessive cooling. In particular, when the elongation of the cold-rolled and annealed steel sheet is to be improved, the temperature reduction is preferably to select to 150° C. or less.

To control the temperature reduction by the rapid cooling to the above-described range, it is effective that the above-described cooling unit which conducts the cooling in nuclear boiling mode is divided into small sub-units in the rolling direction and that the cooling in each of the sub-units is subjected to ON/OFF control linking with the rolling speed. The temperature reduction by the rapid cooling is determined by the cooling speed of the cooling unit for rapid cooling, the length of the section to conduct rapid cooling in the cooling unit, and the rolling speed (travel speed of the steel strip). Therefore, it is difficult to maintain the temperature reduction by the rapid cooling in the above-described range, and also difficult to keep the temperature reduction to a certain level over the whole length of the coil in the longitudinal direction thereof unless the control is performed as described above, thus resulting in dispersed characteristics of the cold-rolled and annealed steel sheet.

In concrete terms, the cooling speed of the rapid cooling in nuclear boiling mode varies with the sheet thickness, or being slowed for thicker sheet and being quickened in thinner sheet. And, the cooling speed is not uniform over the whole length of a coil in most cases. Thus, it is often to reduce the rolling speed until the steel strip winds around the coiler, then to increase the speed to a certain level under tension applied to the steel strip. Consequently, the temperature reduction by the rapid cooling can be adequately controlled by dividing the cooling unit into small sub-units and by determining the number and the positions of the sub-units for the cooling responding to the rolling speed which varies as described above, thus by conducting ON/OFF control on each of the sub-units.

It is further important to promptly remove the water used in the rapid cooling. For example, if the water flows out on and after the exit of the cooling unit, the cooling of steel sheet sustains corresponding to the residual amount of the water. If the water is left on the steel sheet at an excess amount at the exit of the cooling unit, the cooling mode at the area becomes either a mixed mode of nuclear boiling and film boiling or a mode of transition to film boiling mode, depending on the water pressure against the steel sheet and the rolling speed. In any mode, the cooling sustains at a higher cooling speed than that of sole film boiling mode. The phenomenon directly induces dispersion of the effect to improve the characteristics of steel sheet obtained from the rapid cooling. In the case of excessive cooling, no polygonal ferritic grains can be formed. These disadvantages lead to degradation of material quality. To prevent the bad influence, a draining device, a draining roll, an air curtain, or the like may be located at the exit of the cooling unit.

(6) Temperature to stop the rapid cooling is specified to a range of from 650 to 850° C.

The reason to specify the temperature to stop the rapid cooling as above is to adequately conduct the reduction in grain size of the hot-rolled steel sheet, along with the above-described conditions of "cooling speed", "time to start cooling", and "temperature reduction of the rapid cooling". If the temperature to stop cooling exceeds 850° C., the grain growth after the stop cooling cannot be neglected in some cases, which is not preferable in view of reduction of grain size in the hot-rolled steel sheet. If the temperature to stop cooling becomes less than 650° C., a quenched structure may appear even when the above-described conditions of "cooling speed", "time to start cooling", and "temperature reduction of the rapid cooling" are satisfied. In that case, the characteristics of cold-rolled and annealed steel sheet cannot be improved. The temperature to stop the rapid cooling is the temperature of steel sheet at the exit of the rapid cooling unit: defined by [(Finish temperature)–(Temperature reduction by the rapid cooling)]. The temperature to stop the rapid cooling is required to be set, naturally, to the coiling temperature or above. Although the temperature to stop the rapid cooling is the temperature of steel sheet at the exit of the rapid cooling unit. In the case that, for example, the cooling unit comprises multi-bank configuration, the temperature of the steel strip at the point that the steel strip passes through a bank which is used for cooling may be controlled to the above-specified range. To control the temperature to stop cooling to the above-given range, a draining device, a draining roll, an air curtain, or the like may be located at the exit of the cooling unit to control the temperature to stop cooling.

(7) Cooling after the rapid cooling is specified to be carried out by slow cooling or air cooling at speeds of 100° C./sec or less.

After the rapid cooling on a hot-rolling runout table, as described before, the slow cooling or the air cooling is applied at speeds of 100° C./sec or less down to the coiling temperature. The reason of specifying the cooling speed is to improve the characteristics of cold-rolled and annealed steel sheet by forming polygonal and fine ferritic grains as described above. Since sole rapid cooling applied to cool the steel sheet down to the coiling temperature induces bad influence and fails to obtain wanted structure, slow cooling or air cooling at speeds of 100° C./sec or less is an essential step. If the cooling speed exceeds 100° C./sec, formation of polygonal ferritic grains becomes difficult.

(8) Coiling temperature

The coiling temperature is not specifically limited. However, it is preferred to regulate the coiling temperature to a range of from 550 to 750° C. If the coiling temperature is less than 550° C., the resulted steel is hardened. As described above, the rapid cooling inevitably adopts the coiling temperatures of 750° C. or below. And, even if the coiling temperature is brought to above 750° C., the characteristics cannot be improved.

If the steel contains large quantity of C, S, and N, (or 0.002 to 0.004% C, 0.012 to 0.02% S, or 0.002 to 0.004% N), the coiling temperature is preferably selected to a range of from 630 to 750° C. By selecting the range, the formation and growth of precipitates are enhanced, thus removing the elements (fine precipitates) that hinder the growth of ferritic grains in the cold-rolled and annealed steel sheet.

If the steel contains small quantity of C, S, P, and N, (or 0.0003 to 0.002% C, 0.0003 to 0.012% S, 0.003 to 0.015% P, or 0.0003 to 0.002% N), the coiling temperature is preferably selected to a range of from 550 to 680° C. By selecting the range, extremely active growth of grains is suppressed owing to least quantity of these elements, thus effectively performing the reduction in grain size in the hot-rolled steel sheet.

(9) Cold-rolling

The condition of cold-rolling is not specifically limited. However, the reduction in thickness in cold-rolling (cold reduction in thickness) is preferably selected to a range of from 50 to 90%. By selecting the range, the improvement effect of characteristics is attained in the hot-rolled sheet prepared by the above-described procedure giving reduced grain size.

(10) Annealing

The condition of annealing is not specifically limited. However, in view of improvement in characteristics and of prevention of rough surface, the annealing is preferably conducted at temperatures of from 700 to 850° C. Any type of annealing method can be applied such as continuous annealing and batchwise annealing.

According to the Best mode 3, favorable material can be obtained by applying the above-described process conditions to a steel having the above-described compositions, with any type of method: the method of hot-rolling a continuously cast slab without heating in a heating furnace; the method of hot-rolling in which a continuously cast slab is preliminarily heated to a specified temperature in a heating furnace before the slab is cooled to room temperature; the method of hot-rolling in which the slab is preliminarily heated to a specified temperature in a heating furnace after the slab is cooled to room temperature; the method of hot-rolling in which a slab is rolled in a connected facility of a thin slab continuous casting unit and a hot-rolling mill; and the method of hot-rolling in which an slab prepared from ingot is trimmed and then heated in a heating furnace.

The cold-rolled steel sheets according to the Best mode 3 can be preferably applied to the uses particularly requiring workability, which uses include the steel sheets for automobiles, steel sheets for electric equipment, steel sheets for cans, and steel sheets for buildings. The cold-rolled steel sheets according to the Best mode 2 function their characteristics fully also in other uses. The cold-rolled steel sheets according to the Best mode 2 includes those of surface-treated, such as Zn plating and alloyed Zn plating.

The Best mode 3 is described below referring to examples.

EXAMPLE 1

Each of the steels having the compositions of Table 8 was formed in a slab having individual thicknesses of from 200 to 300 mm. The slab was heated to respective temperatures of from 1,180 to 1,250° C., and was hot-rolled under respective hot-rolling conditions including the cooling conditions given in Table 9, to form a hot-rolled steel sheet having a thickness of 2.8 mm. The hot-rolled steel sheet was cold-rolled to a thickness of 0.8 mm. Then the steel sheet was heated at respective speeds of from 6 to 20° C./sec, followed by continuously annealing at respective annealing temperatures given in Table 9 for 90 seconds to obtain each of the cold-rolled steel sheets Nos. 1 through 18. On applying hot-rolling, the sheet bar (a hot-rolled steel strip after completing the rough-rolling) was heated by an induction heating unit immediately before the introduction to the finish-rolling unit to secure the transferability and the shape property of the hot-rolled steel strip at a level that induces no problem, thus attained uniform temperature distribution in the width direction of the steel strip. The steel sheets indicated by "conventional laminar cooling" in Table 9 were those subjected to laminar cooling which applies cooling to the hot-rolled steel strip after passing the final pass of the finish rolling while generating steam. For the steel sheets which were subjected to rapid cooling at speeds of 200° C./sec or more after the finish rolling, the cooling in nuclear boiling mode generates steam on cooling, and the generated steam forms a film to enclose the steel sheet to hinder the rapid cooling. Consequently, a perforated ejection type cooling unit was applied to establish the cooling of nuclear boiling mode that conducts cooling while breaking the steam film, which makes the steel sheet always being exposed to fresh water to conduct the rapid cooling. By varying the quantity and pressure of water given in Table 9, the rapid cooling was carried out.

With thus prepared steel sheets, total elongation was determined on the cold-rolled steel sheets having a thickness of 0.8 mm, and r0, r45, and r90 were determined, (r0 is the r value in the L direction (0° to the rolling direction), where r45 is the r value in the D direction (45° to the rolling direction), and r90 is the C direction (90° to the rolling direction). Table 9 shows the total elongation and the average r value as the indexes to evaluate the workability of the steel sheets. And, as an index to evaluate the anisotropic property, for the steel sheet that provides r45 as the minimum value among r0, r45, and r90, the value of Δr was applied, and for the steel sheet that provides r45 as intermediate value between r0 and r90, the value of (maximum value−minimum value) of the r value was applied. The average r value referred herein is defined by:

$$\text{Average } r \text{ value}=(r0+2\times r45\times r90)/4$$

The Δr is defined by:

$$\Delta r=(r0+r90-2\times r45)/2$$

TABLE 8

| | C | Si | Mn | P | S | sol. Al | N | Cu | B | Ti | Nb | V | Zr | Remark |
|---|---|---|---|---|---|---|---|---|---|---|---|---|---|---|
| A | 0.0018 | 0.01 | 0.15 | 0.008 | 0.0115 | 0.035 | 0.0019 | 0.018 | — | 0.031 | 0.015 | — | — | Example steel |
| B | 0.0006 | 0.01 | 0.17 | 0.004 | 0.0034 | 0.044 | 0.0009 | 0.010 | 0.0004 | — | — | — | — | Example steel |
| C | 0.0009 | 0.01 | 0.11 | 0.003 | 0.0021 | 0.040 | 0.0010 | 0.010 | 0.0003 | 0.030 | — | — | — | Example steel |
| D | 0.0035 | 0.01 | 0.17 | 0.012 | 0.0175 | 0.045 | 0.0018 | 0.020 | — | 0.085 | — | 0.005 | 0.002 | Example steel |
| E | 0.0020 | 0.01 | 0.17 | 0.011 | 0.0110 | 0.045 | 0.0034 | 0.010 | — | 0.071 | — | — | — | Example steel |
| F | 0.0018 | 0.01 | 0.15 | 0.008 | 0.0115 | 0.035 | 0.0019 | 0.080 | 0.0002 | 0.045 | — | — | — | Example steel |
| G | 0.0020 | 0.01 | 0.65 | 0.050 | 0.0092 | 0.045 | 0.0025 | 0.010 | — | 0.020 | 0.02 | — | — | Example steel |
| H | 0.0021 | 0.01 | 1.00 | 0.075 | 0.0070 | 0.045 | 0.0024 | 0.013 | 0.0006 | 0.045 | — | — | — | Example steel |
| I | 0.0025 | 0.01 | 2.10 | 0.075 | 0.0085 | 0.045 | 0.0028 | 0.013 | 0.0011 | 0.045 | — | — | — | Example steel |

TABLE 9

| No. | Material | Total reduction in thickness of two passes before the final pass (%) | Reduction in thickness at the final pass (%) | Finish temp (° C.) | Cooling by rapid cooling: Cooling speed (° C./sec) | Cooling by rapid cooling: Time for beginning the cooling (sec) | Cooling by rapid cooling: Temp reduction (° C.) | Cooling by rapid cooling: Temp to stop the rapid cooling (° C.) | Cooling speed after the rapid cooling (° C./sec) | Coiling temp (° C.) | Annealing temp (° C.) | Total elongation (%) | Average r value | Δr | Difference between the max value and the min. value of r | Remark |
|---|---|---|---|---|---|---|---|---|---|---|---|---|---|---|---|---|
| 1 | A | 53 | 14 | 900 | 40 | | (Conventional laminar cooling) | | | 630 | 850 | 57.9 | 1.85 | 0.79 | — | C |
| 2 | A | 53 | 14 | 900 | 230 | 0.2 | 130 | 770 | 30 | 630 | 850 | 59.0 | 2.37 | 0.49 | — | E |
| 3 | B | 48 | 20 | 910 | 40 | | (Conventional laminar cooling) | | | 640 | 850 | 55.6 | 1.75 | 0.77 | — | C |
| 4 | B | 48 | 20 | 910 | 220 | 0.3 | 130 | 780 | 40 | 640 | 850 | 57.9 | 2.01 | 0.64 | — | E |
| 5 | C | 51 | 10 | 905 | 40 | | (Conventional laminar cooling) | | | 590 | 850 | 58.7 | 2.00 | 0.69 | — | C |
| 6 | C | 51 | 10 | 905 | 395 | 0.2 | 200 | 705 | 40 | 590 | 850 | 60.3 | 2.37 | 0.39 | — | E |
| 7 | D | 55 | 15 | 910 | 40 | | (Conventional laminar cooling) | | | 680 | 850 | 58.3 | 1.99 | 0.64 | — | C |
| 8 | D | 55 | 16 | 910 | 260 | 0.3 | 170 | 740 | 35 | 680 | 850 | 59.4 | 2.55 | 0.40 | — | E |
| 9 | E | 67 | 18 | 920 | 40 | | (Conventional laminar cooling) | | | 640 | 850 | 57.9 | 1.95 | 0.70 | — | C |
| 10 | E | 67 | 18 | 920 | 450 | 0.4 | 130 | 790 | 43 | 640 | 850 | 59.4 | 2.44 | 0.41 | — | E |
| 11 | F | 49 | 20 | 915 | 40 | | (Conventional laminar cooling) | | | 640 | 850 | 58.3 | 1.93 | 0.66 | — | C |
| 12 | F | 49 | 20 | 915 | 300 | 0.3 | 130 | 785 | 43 | 640 | 850 | 59.8 | 2.41 | 0.44 | – | E |
| 13 | G | 46 | 33 | 905 | 40 | | (Conventional laminar cooling) | | | 640 | 810 | 43.3 | 1.92 | — | 0.52 | C |
| 14 | G | 46 | 33 | 905 | 350 | 0.3 | 130 | 775 | 40 | 640 | 810 | 45.3 | 2.19 | — | 0.38 | E |
| 15 | H | 47 | 20 | 900 | 40 | | (Conventional laminar cooling) | | | 640 | 800 | 40.2 | 1.85 | — | 0.54 | C |
| 16 | H | 47 | 20 | 900 | 405 | 0.3 | 80 | 820 | 60 | 640 | 800 | 42.0 | 2.11 | — | 0.41 | E |
| 17 | I | 46 | 6 | 895 | 40 | | (Conventional laminar cooling) | | | 640 | 785 | 36.0 | 1.51 | — | 0.50 | C |
| 18 | I | 46 | 6 | 895 | 520 | 0.3 | 150 | 745 | 40 | 640 | 785 | 36.7 | 1.87 | — | 0.43 | E |

Figures with underline are out of the scope of the present invention.
C: Comparative example
E: Example As seen in Table 9, the steel sheets Nos. 2, 4, 6, 8, 10, 12, 14, 16, and 18 which were manufactured by rapid cooling under the process conditions of Best mode 3 gave extremely superior elongation and average r value, while suppressing the value of Δr or (maximum r value−minimum r value) to an extremely low level. Thus, these steels provided extremely superior workability and less-anisotropic property. To the contrary, the steel sheets Nos. 1, 3, 5, 7, 9, 11, 13, 15, and 17 which were subjected to laminar cooling from both upper side and lower side of the steel sheets on the runout table after the final pass showed inferiority in either one of above-given characteristics.

As described above, it was confirmed that, if the steels having the compositions within the range specified by the Best mode 3, and if the cold-rolled steel sheets are manufactured under the process conditions specified by the Best mode 3, the cold-rolled steel sheets giving superior shape property and transferability having far superior workability and less-anisotropic property to conventional ones can be manufactured.

EXAMPLE 2

The steels having the compositions given in Table 10 were continuously cast to form slabs having 220 mm in thickness. After trimming, the slab was heated to 1,200° C., hot-rolled and cold-rolled under respective conditions given in Table 11, then continuously annealed at respective temperature increase speeds of from 10 to 20° C./sec and at annealing temperature of 840° C. for 90 seconds, thus obtained cold-rolled steel sheets Nos. 19 through 44. On applying hot-rolling, aiming to ensure the transferability and the shape property of the hot-rolled steel strip to a level that does not induce problem, a sheet bar (a hot-rolled steel strip after completing the rough-rolling) was heated by an induction heating unit immediately before the introduction to the finish-rolling unit to uniformize the temperature distribution in the width direction of the steel strip. As for the steel sheet No. 30, the thickness of hot-rolled steel sheet was 1.5 mm, and the thickness of cold-rolled and annealed steel sheet was 0.75 mm. For other steel sheets Nos. 19 through 29 and 31 through 44, the thickness of hot-rolled steel sheet was 28±0.2 mm, and the thickness of cold-rolled and annealed steel sheet was 0.8 mm. The cooling speed of the steel sheet No. 30 in Table 11 was the value for the 1.5 mm in thickness of hot-rolled steel sheet, and the confirmation of the cooling speed on the steel sheets having thicknesses of from 2.8 to 3.5 mm gave the cooling speed of 70±70° C./sec. Thus obtained characteristics of cold-rolled steel sheets were evaluated in the same procedure with Example 1. The result is given in Table 11. The total elongation of the steel sheet No. 30 was the value converting the value observed on a cold-rolled steel sheet having 0.75 mm in thickness into the elongation of 0.8 mm thickness sheet using the Oliver's rule.

TABLE 10

| C | Si | Mn | P | S | sol. Al | N | Cu | B | Ti | Nb | V | Zr |
|---|---|---|---|---|---|---|---|---|---|---|---|---|
| 0.0015 | tr | 0.12 | 0.006 | 0.0085 | 0.030 | 0.0015 | 0.016 | — | 0.03 | 0.01 | — | — |
| \| | \| | \| | \| | \| | \| | \| | \| | | \| | \| | | |
| 0.0020 | 0.01 | 0.17 | 0.009 | 0.012 | 0.04 | 0.0025 | 0.030 | | 0.04 | 0.02 | | |

TABLE 11

| No. | Total reduction in thickness of two passes before the final pass (%) | Reduction in thickness at the final pass (%) | Finish temperature (° C.) | Cooling by rapid cooling: Cooling speed (° C./sec) | Cooling by rapid cooling: Time for beginning the cooling (sec) | Cooling by rapid cooling: Temperature reduction (° C.) | Cooling by rapid cooling: Temperature to stop the rapid cooling (° C.) | Cooling speed after the rapid cooling (° C./sec) | Coiling temperature (° C.) | Total elongation (%) | Average r value | Δr | Remark | Others |
|---|---|---|---|---|---|---|---|---|---|---|---|---|---|---|
| 19 | 76 | 20 | 910 | 200 | 0.2 | 170 | 740 | 40 | 630 | 60.2 | 2.42 | 0.45 | C | Boththetransferability andthe shapeweretoo bad |
| 20 | 48 | 15 | 905 | 250 | 0.3 | 150 | 755 | 50 | 650 | 60.3 | 2.37 | 0.49 | E | |
| 21 | 50 | 39 | 900 | 220 | 0.3 | 150 | 750 | 50 | 650 | 61.0 | 2.47 | 0.41 | C | Boththetransferability andthe shapeweretoo bad |
| 22 | 55 | 20 | 820 | 210 | 0.3 | 130 | 690 | 35 | 650 | 46.8 | 1.52 | 0.84 | C | |
| 23 | 58 | 18 | 915 | 210 | 0.3 | 130 | 785 | 35 | 650 | 53.0 | 1.64 | 0.79 | C | |
| 24 | 58 | 20 | 905 | 180 | 0.3 | 130 | 775 | 38 | 650 | 58.6 | 1.97 | 0.73 | C | |
| 25 | 60 | 20 | 895 | 400 | 0.3 | 150 | 745 | 40 | 650 | 62.3 | 2.54 | 0.41 | E | |
| 26 | 60 | 20 | 900 | 600 | 0.3 | 150 | 750 | 40 | 650 | 63.4 | 2.56 | 0.40 | E | |
| 27 | 58 | 21 | 900 | 900 | 0.3 | 150 | 750 | 45 | 650 | 61.8 | 2.52 | 0.44 | E | |
| 28 | 60 | 20 | 895 | 1200 | 0.3 | 150 | 745 | 45 | 650 | 61.6 | 2.48 | 0.45 | E | |
| 29 | 59 | 21 | 910 | 1900 | 0.3 | 150 | 760 | 40 | 650 | 57.9 | 2.42 | 0.46 | E | |
| 30* | 61 | 19 | 910 | 1850 | 0.3 | 250 | 660 | 40 | 650 | 57.8 | 2.39 | 0.41 | E | |
| 31 | 47 | 20 | 905 | 400 | 5 | 145 | 760 | 35 | 650 | 57.4 | 1.90 | 0.77 | C | |
| 32 | 48 | 20 | 904 | 405 | 2 | 145 | 759 | 35 | 650 | 57.7 | 2.12 | 0.60 | C | |
| 33 | 49 | 19 | 905 | 400 | 1 | 145 | 760 | 36 | 650 | 62.5 | 2.29 | 0.49 | E | |
| 34 | 47 | 20 | 905 | 400 | 0.6 | 145 | 760 | 40 | 650 | 61.9 | 2.32 | 0.47 | E | |
| 35 | 47 | 20 | 904 | 400 | 0.1 | 145 | 759 | 37 | 650 | 59.9 | 2.45 | 0.48 | E | |
| 36 | 47 | 20 | 905 | 400 | 0.02 | 145 | 760 | 35 | 650 | 58.8 | 2.59 | 0.39 | E | |
| 37 | 55 | 13 | 900 | 400 | 0.3 | 30 | 870 | 38 | 650 | 57.0 | 1.88 | 0.76 | C | |
| 38 | 54 | 14 | 900 | 450 | 0.3 | 50 | 850 | 38 | 650 | 59.1 | 2.31 | 0.46 | E | |
| 39 | 55 | 13 | 900 | 450 | 0.3 | 150 | 750 | 40 | 650 | 60.2 | 2.40 | 0.40 | E | |
| 40 | 55 | 13 | 900 | 450 | 0.3 | 240 | 660 | 37 | 650 | 58.3 | 2.47 | 0.37 | E | |
| 41 | 54 | 14 | 900 | 450 | 0.3 | 360 | 540 | 45 | 410 | 50.6 | 1.30 | 0.86 | C | |
| 42 | 50 | 20 | 900 | 450 | 0.3 | 250 | 640 | 35 | 580 | 48.2 | 1.48 | 0.81 | C | |
| 43 | 50 | 20 | 915 | 300 | 0.4 | 200 | 715 | 150 | 610 | 49.9 | 1.83 | 0.72 | C | |
| 44 | 47 | 30 | 915 | 300 | 0.4 | 200 | 715 | 90 | 610 | 60.6 | 2.45 | 0.43 | E | |

Figures with underline are out of the scope of the present invention.

*Thickness of hot-rolled steel sheet was 1.5 mm; thickness of cold-rolled steel sheet was 0.75 mm; elongation was converted to that of 0.8 mm sheet applying the Oliver's rule.

C: Comparative example

E: Example

As shown in Table 11, the steel sheets Nos. 20, 25 through 30, 33 through 36, 38 through 40, and 44, manufactured under the process conditions of the Best mode 3 provided shape property and transferability of the steel sheet at a level inducing no problem, and gave extremely high elongation and average r value, while suppressing the value of Δr to an extremely low level, and giving excellent workability and less-anisotropic property. To the contrary, the steel sheets Nos. 19, 21 through 24, 31, 32, 37, and 41 through 43, which gave either one of the conditions outside of the range of the Best mode 3, showed inferiority in either one of the above-given characteristics.

In concrete terms, the steel sheets Nos. 19 and 21 induced transverse displacement during manufacturing and showed bad shape property and transferability of the steel sheet, thus ending in difficulty in stable manufacturing because the steel sheet No. 19 gave the total reduction in thickness of two passes before the final pass above the range of the Best mode 3, and because the steel sheet No. 21 gave the reduction in thickness at final pass above the range of the Best mode 3. Table 11 shows most favorable data among the material characteristics provided by the samples of cold-rolled and annealed steel sheets obtained from a part of the hot-rolled coil prepared. As seen in Table 11, the steel sheets Nos. 19 and 21 were difficult to manufacture and gave significant dispersion of material characteristics, though they showed excellent material characteristics in some cases.

The steel sheet No. 22 gave the finish temperature below the range of the Best mode 3 so that the α-region rolling was established, which resulted in significant degradation of total elongation. The steel sheet No. 23 gave the finish temperature above the range of the Best mode 3, thus the characteristics were inferior. This presumably comes from that the growth of γ-grains presumably proceeded until the rapid cooling began, which led the insufficient reduction in grain size of the hot-rolled steel sheet, thus degrading the characteristics. The steel sheet No. 24 gave lower cooling speed than the range of the Best mode 3, so the rapid cooling was insufficient and the grain size reduction in the hot-rolled steel sheet was not attained, thus failing to obtain full improvement effect of r-value. The steel sheets Nos. 31 and 32 gave longer time to start cooling than the range of the Best mode 3, thus the grains should be fully grown. As a result, the grain size reduction in the hot-rolled steel sheet was not sufficient, and the improvement of workability and less-anisotropic property was not fully attained. The steel sheet No. 37 gave less temperature reduction in the rapid cooling than the range of the Best mode 3, so that the grain size reduction in the hot-rolled steel sheet was not sufficient, thus the improvement effect of r-value could not fully be attained. The steel sheet No. 41 gave larger temperature reduction in rapid cooling than the range of the Best mode 3, gave the temperature to stop rapid cooling below the range of the Best mode 3, and gave the coiling temperature lower than the preferred range of the Best mode 3, so that the structure of the hot-rolled steel sheet entered the quenched structure, thus significantly degrading the characteristics. The steel sheet No. 42 gave lower temperature to stop rapid cooling than the range of the Best mode 3, so the structure of the hot-rolled steel sheet did not become polygonal fine grains, and degraded the characteristics. The steel sheet No. 43 gave higher cooling speed after the rapid cooling than the range of the Best mode 3, so that the polygonal fine grains could not be formed at the hot-rolled steel sheet stage, and all the characteristics were inferior.

As described above, it was confirmed that only the manufacturing method that satisfies all the conditions specified by the Best mode 3 can manufacture the cold-rolled steel sheets having superior shape property and transferability, and giving far superior workability and less-anisotropic property to conventional method.

What is claimed is:

1. A method for manufacturing a cold-rolled steel sheet comprising the steps of:

(a) providing a slab consisting essentially of 0.02% or less C, 0.5% or less Si, 2.5% or less Mn, 0.10% or less P, 0.05% or less S. 0.003% or less O, 0.003% or less N, 0.01to 0.40% of at least one element selected from the group consisting of Ti, Nb, V, and Zr, by weight, optionally 0.0001 to 0.005% by weight of B, and a balance being Fe;

(b) rough-rolling the slab by a rough-rolling mill to form a sheet bar;

(c) finish-rolling the sheet bar by a continuous hot finish-rolling mill to form a hot-rolled steel strip, the finish-rolling comprising finish-rolling the sheet bar so that a material temperature at a final stand of the finish-rolling mill becomes an $Ar_3$ transformation point or more over the whole range of from a front end of the sheet bar to a rear end thereof;

(d) cooling the hot-rolled steel strip on a runout table and coiling the cooled hot-rolled steel strip at a coiling temperature, the cooling on the runout table beginning with a time range of from more than 0.1 second and less than 1.0 second after completing the finish-rolling, the cooling on the runout table being conducted at an average cooling speed in a temperature range of from a hot-rolling finish temperature to 700° C. being 120° C./sec or more, an average cooling speed in a temperature range of from 700° C. to the coiling temperature being 50° C./sec or less, the coiling temperature of the hot-rolled steel strip being less than 700° C.; and (e) pickling and cold rolling the hot-rolled steel strip, and final annealing the cold-rolled steel strip.

2. The method of claim 1, wherein the slab further contains 0.0001 to 0.005% B by weight.

3. The method of claim 1, wherein the finish-rolling is carried out at a reduction in thickness in a range of from more than 5% to less than 30% at the final stand of the finish-rolling mill.

4. The method of claim 1, wherein the finish-rolling is carried out so that the material temperature at the final stand of the finish rolling mill becomes a range of from $Ar_3$ transformation point to ($Ar_3$ transformation point+50° C.) over the whole range of from the front end of the sheet bar to the rear end thereof.

5. The method of claim 4, wherein the finish-rolling is carried out so that the material temperature at the final stand of the finish-rolling mill becomes a range of from $Ar_3$ transformation point to ($Ar_3$ transformation point+40° C.) over the whole range of from the front end of the sheet bar to the rear end thereof.

6. The method of claim 1, further comprising the step of heating the sheet bar using a heating unit which is placed at inlet of the continuous hot finish-rolling mill and/or between the finish-rolling mill stands.

7. The method of claim 6, wherein the step of heating the sheet bar comprises heating edge portions in width direction of the sheet bar by a heating unit.

8. The method of claim 6, wherein the heating unit is an induction heating unit.

9. The method of claim 1, further comprising the step of accelerating the rolling speed of the roughly-rolled steel bar after the front end of the sheet bar entered into the continuous hot finish-rolling mill, followed by maintaining or further accelerating the rolling speed.

10. A method for manufacturing a cold-rolled steel sheet comprising the steps of:

(a) heating a slab consisting essentially of 0.0003 to 0.004% C, 0.05% or less Si, 0.05 to 2.5% Mn, 0.003 to 0.1% P, 0.0003 to 0.02% S, 0.005 to 0.1% sol.Al, 0.0003 to 0.004% N, by weight, optionally (i) 0.005 to 0.1% by weight of at least one element selected from the group consisting of Ti, Nb, V and Zr, or (ii) 0.015 to 0.8% Cu by weight or (iii) 0.0001 to 0.001% B by weight, and a balance of Fe;

(b) hot-rolling the slab to form a hot-rolled steel strip; and (c) cold-rolling the hot-rolled steel strip to form a cold-rolled steel strip and annealing the cold-rolled steel strip, the step of hot-rolling comprising finish-rolling, cooling, and coiling, the finish-rolling having a total reduction in thickness of two passes before a final pass being in a range of from 25 to 45%, a reduction in thickness at the final pass being in a range of from 5 to 25%, and a finishing temperature being in a range of from the $Ar_3$ transformation point to the ($Ar_3$ transformation point+50° C.), and the cooling being carried out by a rapid cooling at a cooling speed in a range of from 200 to 2,000° C./sec within 1 second after completing the finish rolling, a temperature reduction from the finishing temperature of the finish rolling in the rapid cooling being in a range of from 50 to 250° C., and a temperature to stop the rapid cooling being in a range of from 650 to 850° C., followed by applying slow cooling or air cooling at a rate of 100° C./sec or less, the coiling being carried out at a coiling temperature of 550 to 750° C.

11. The method of claim 10, wherein the slab further contains 0.005 to 0.1% of at least one element selected from the group consisting of Ti, Nb, V, and Zr, by weight.

12. The method of claim 10, wherein the slab further contains 0.015 to 0.08% Cu by weight.

13. The method of claim 10, wherein the slab further contains 0.0001 to 0.001% B by weight.

14. A method for manufacturing a cold-rolled steel sheet comprising the steps of:

(a) heating a slab consisting essentially of 0.0003 to 0.004% C, 0.05% or less Si, 0.05 to 2.5% Mn, 0.003 to 0.1% P, 0.0003 to 0.02% S, 0.005 to 0.1% sol.Al, 0.0003 to 0.004% N, by weight, optionally (i) 0.005 to 0.1% by weight of at least one element selected from the group consisting of Ti, Nb, V and Zr, or (ii) 0.015 to 0.8% Cu by weight or (iii) 0.0001 to 0.001% B by weight, and a balance of Fe;

(b) hot-rolling the heated slab to form a hot-rolled steel strip; and (c) cold-rolling the hot-rolled steel strip to form a cold-rolled steel sheet and annealing the cold-rolled steel sheet;

the step of hot-rolling comprising finish-rolling, cooling, and coiling, a total reduction in thickness of two passes before a final pass being in a range of from 45 to 70%, a reduction in thickness at the final pass being in a range of from 5 to 35%, and a finishing temperature being in a range of from the $Ar_3$ transformation point to the ($Ar_3$ transformation point+50° C.), and the cooling being carried out by a rapid cooling at a cooling speed of from 200 to 2,000° C./sec within 1 second after completing the finish rolling, a temperature reduction from the finishing temperature of the finish-rolling in the rapid cooling being in a range of from 50 to 250° C., and a temperature to stop the rapid cooling being in a range of from 650 to 850° C., followed by applying slow cooling or air cooling at a rate of 100° C./sec or less, the coiling being carried out at a coiling temperature of 550 to 750° C.

15. The method of claim 14, wherein the slab further contains 0.005 to 0.1% of at least one element selected from the group consisting of Ti, Nb, V, and Zr, by weight.

16. The method of claim 14, wherein the slab further contains 0.015 to 0.08% Cu by weight.

17. The method of claim 14, wherein the slab further contains 0.0001 to 0.001% B by weight.

18. The method of claim 10, wherein the C content of the slab is 0.0003 to 0.002% by weight.

19. The method of claim 14, wherein the C content of the slab is 0.0003 to 0.002% by weight.

20. The method of claim 10, wherein the cooling is carried out by a rapid cooling at a cooling speed of 400 to 2,000° C./sec within 1 second after completing the finish rolling.

21. The method of claim 14, wherein the cooling is carried out by a rapid cooling at a cooling speed of 400 to 2,000° C./sec within 1 second after completing the finish rolling.

22. The method of claim 1, wherein the cold-rolled steel sheet has an r-value of 2.70 to 2.90.

* * * * *